US006261207B1

(12) United States Patent
Publicover et al.

(10) Patent No.: US 6,261,207 B1
(45) Date of Patent: Jul. 17, 2001

(54) TRAMPOLINE OR THE LIKE WITH ENCLOSURE

(75) Inventors: Mark W. Publicover, Saratoga; Jon H. Greiner, Palo Alto, both of CA (US); J. Scott Publicover, Boise, ID (US); Byron L. Bertsch, San Jose, CA (US)

(73) Assignee: JumpSport, Inc., Saratoga, CA (US)

( * ) Notice: Subject to any disclaimer, the term of this patent is extended or adjusted under 35 U.S.C. 154(b) by 0 days.

(21) Appl. No.: 09/432,998

(22) Filed: Nov. 2, 1999

Related U.S. Application Data

(63) Continuation of application No. 09/100,586, filed on Jun. 19, 1998.

(60) Provisional application No. 60/050,323, filed on Jun. 20, 1997, provisional application No. 60/052,052, filed on Jul. 9, 1997, and provisional application No. 60/087,835, filed on Jun. 3, 1998.

(51) Int. Cl.[7] ..... A63B 5/11

(52) U.S. Cl. ..... 482/27; 482/28; 482/29

(58) Field of Search ..... 482/29, 28, 27, 482/24, 35, 36; 256/45, 46; 160/135; 52/234; 5/99.1, 100

(56) References Cited

U.S. PATENT DOCUMENTS

| | | |
|---|---|---|
| D. 382,618 | 8/1997 | Gift . |
| 3,201,126 | 8/1965 | Nissen . |
| 3,339,925 | 9/1967 | Nissen . |
| 3,837,643 | 9/1974 | Lee . |
| 4,284,271 | 8/1981 | Pettit et al. . |
| 4,413,361 | 11/1983 | Wolf et al. . |
| 4,433,838 | 2/1984 | Gordon . |
| 4,478,420 | 10/1984 | Sowards . |
| 4,569,515 | 2/1986 | Gordon . |
| 4,598,905 | 7/1986 | Vrana . |
| 4,644,892 | 2/1987 | Fisher . |
| 4,776,581 | 10/1988 | Shepherdson . |
| 4,836,530 | 6/1989 | Stanley, Jr. . |
| 4,900,011 | 2/1990 | Nolet . |
| 5,010,603 | 4/1991 | Hertzog . |
| 5,390,913 | 2/1995 | Kepler . |
| 5,399,132 | 3/1995 | Bailey . |
| 5,545,110 | 8/1996 | Hsiang . |
| 5,575,738 | 11/1996 | Millington et al. . |
| 5,664,769 | 9/1997 | Sadinsky et al. . |
| 5,711,743 | 1/1998 | Nichols, Jr. et al. . |

FOREIGN PATENT DOCUMENTS

| | | |
|---|---|---|
| 256293 | 2/1964 | (AU) . |
| 2623719A | 6/1989 | (FR) . |

*Primary Examiner*—Jerome W. Donnelly
(74) *Attorney, Agent, or Firm*—Klarquist Sparkman Campbell Leigh & Whinston, LLP

(57) ABSTRACT

A fence surrounds a trampoline and extends above the rebounding surface, reducing the risk of injury. Shock absorption is aided in the preferred embodiment by a support system of independent poles, linked at their tops by a flexible strap or line. An impact anywhere on the fence causes the posts to flex inwardly, absorbing the force. Much of this impact injury is stored in system components and is subsequently returned, helping propel an errant jumper back onto to the rebounding surface. Numerous other embodiments and accessories are also detailed. Similar arrangements are suitable for use with above ground pools.

40 Claims, 10 Drawing Sheets

TRAMPOLINE OR THE LIKE WITH ENCLOSURE

RELATED APPLICATION DATA

This is a continuation of U.S. application Ser. No. 09/100,586, which claims the benefit of U.S. Provisional Application No. 60/050,323, filed Jun. 20, 1997, U.S. Provisional Application No. 60/052,052, filed Jul. 9, 1997, and U.S. Provisional Application No. 60/087,835, filed Jun. 3, 1998. These prior applications are incorporated herein by reference.

BACKGROUND AND SUMMARY OF THE INVENTION

The present invention concerns wall structures used with trampolines to protect trampoline users, and to provide new uses for trampolines. (The same principles can similarly be adapted to provide fencing around above-ground pools, thereby keeping pool toys within the pool, and providing structural support for recreational accessories.)

In the past, trampolines have been used for a variety of athletic and recreational purposes. However, injuries have sometimes resulted when a person jumping on a trampoline would land too near the boundary of the rebounding surface and strike the trampoline frame or fall from the trampoline to the ground. An article in the Mar. 3, 1998, New York Times reports that trampoline-related emergency room hospitalizations of children doubled between 1990 and 1995 (to nearly 60,000), and that the rate of injuries shows no sign of abating. Some in the medical community have called for a ban on the sale of home trampolines. While stopping short of a ban, the U.S. Consumer Products Safety Commission has called for safety improvements to home trampolines.

One approach to reducing such injuries has been to form a wall around the perimeter of a trampoline bed so that when a jumper lands too near the edge, the wall prevents the jumper from falling off. Examples are shown in U.S. Pat. Nos. 5,399,132 and 3,501,141. However, these devices suffer from various drawbacks, in some cases introducing their own safety concerns. For example, the '132 patent employs a rigid framework around the trampoline to support net fencing. If a jumper collides with one of the rigid uprights, the support frame provides little resilience and thus poses its own risk of injury.

In accordance with a preferred embodiment of the present invention, this and other drawbacks of the prior art are overcome, and new features are provided.

One novel aspect of the preferred embodiment is the provision of a safety fence support employing poles whose tops are linked by a resilient, rather than a rigid, member. Such an arrangement permits constrained movement of each pole, better absorbing impact to or near the pole. Moreover, the resilient linking of poles allows a neighborhood of plural poles (commonly all of the poles) to absorb energy from a jumper's impact anywhere against the safety fence. The subsequent release of this energy from the flexed poles helps propel the jumper back onto the trampoline surface. (A cushioning foam sheath can be provided around each of the uprights to enhance the foregoing effects.)

Another novel aspect of the preferred embodiment is the use of a controllable tensioning member on the member(s) linking the pole tops. One embodiment employs nylon webbing for the resilient linking member. A buckle joins two ends of the webbing and permits the webbing's length—and thus tension—to be varied. By varying this tension, the dynamic characteristics of the safety fence can be tailored as desired.

Another novel aspect of the preferred embodiment is the fastening of fence netting material to the support structure by continuous lengths of elastic cording. This arrangement is simple and inexpensive to implement, while enhancing the flexible response of the fence. In a particular embodiment, the elastic cording is threaded in and out of openings in fence netting. This embodiment further includes a flexible member (e.g. nylon webbing) helically wrapped around an adjacent upright support member to couple the cord thereto at plural intermediate points therealong.

Another novel aspect of the preferred embodiment is various game accessories that are used in conjunction with the trampoline and are mounted using some part of the safety fence for support.

The foregoing aspects, and others described below, are equally applicable to embodiments in which the safety fence is provided as an integral component of the trampoline, and also when it is provided as an add-on accessory. By providing the safety fence as an integral part of the trampoline structure, the cost, complexity, and weight of the combined structure can be reduced.

Another novel aspect of the preferred embodiment is a mounting arrangement that permits a fence readily to be attached to trampolines of different designs.

Like fences for trampolines, fences for above-ground pools are also known, as illustrated by U.S. Pat. No. 4,623,126. But these, too, suffer from various drawbacks, including complexity, difficulty of installation, and expense. Embodiments of the present invention overcome these drawbacks as well.

The foregoing features and advantages will be more readily apparent from the following detailed description, which proceeds with reference to the accompanying drawings.

DETAILED DESCRIPTION

Trampoline Fence

Figure 1:
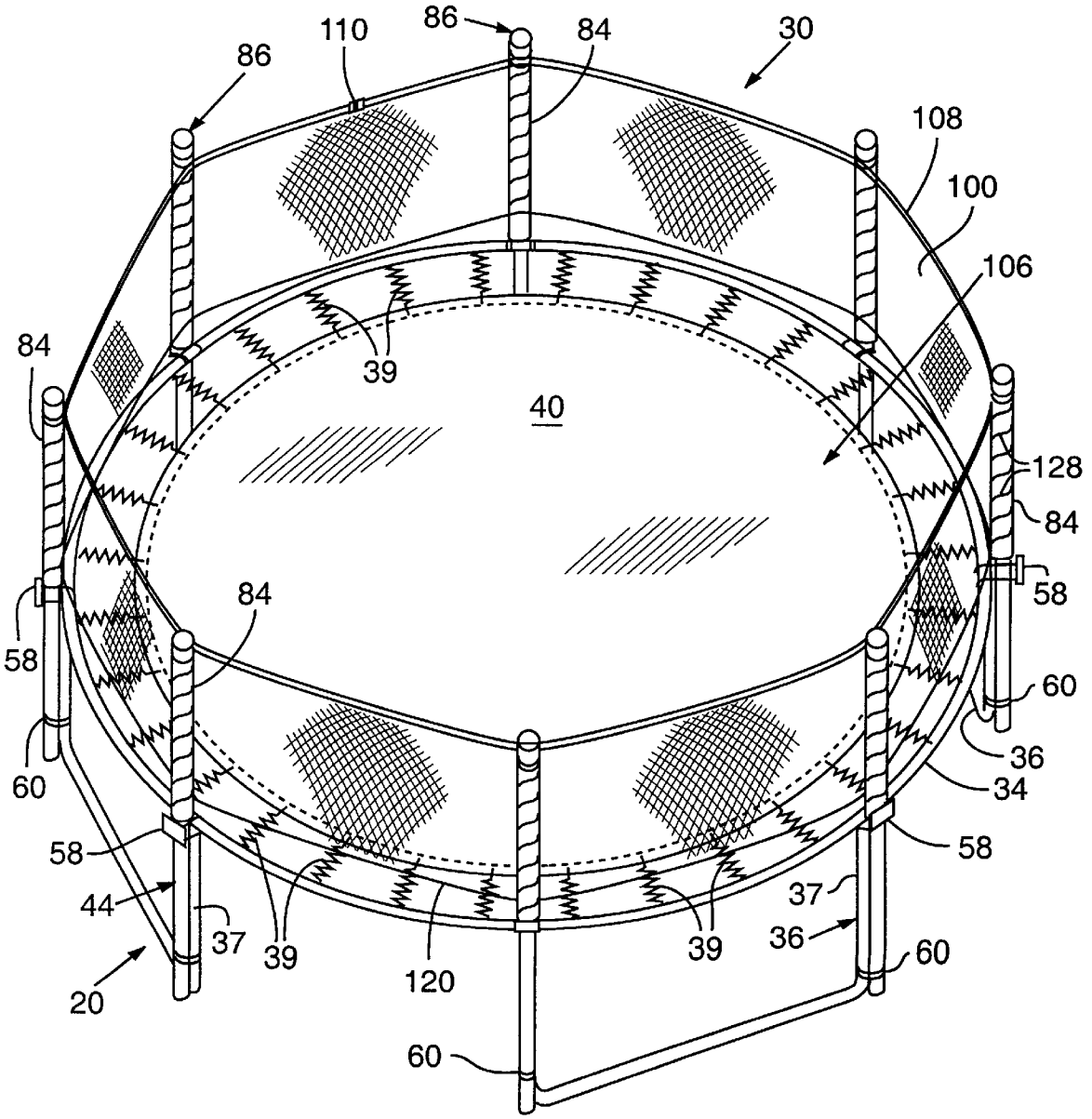
FIG. 1 is an oblique view showing a trampoline apparatus including an enclosure system according to one embodiment of the present invention.
Figure 2:
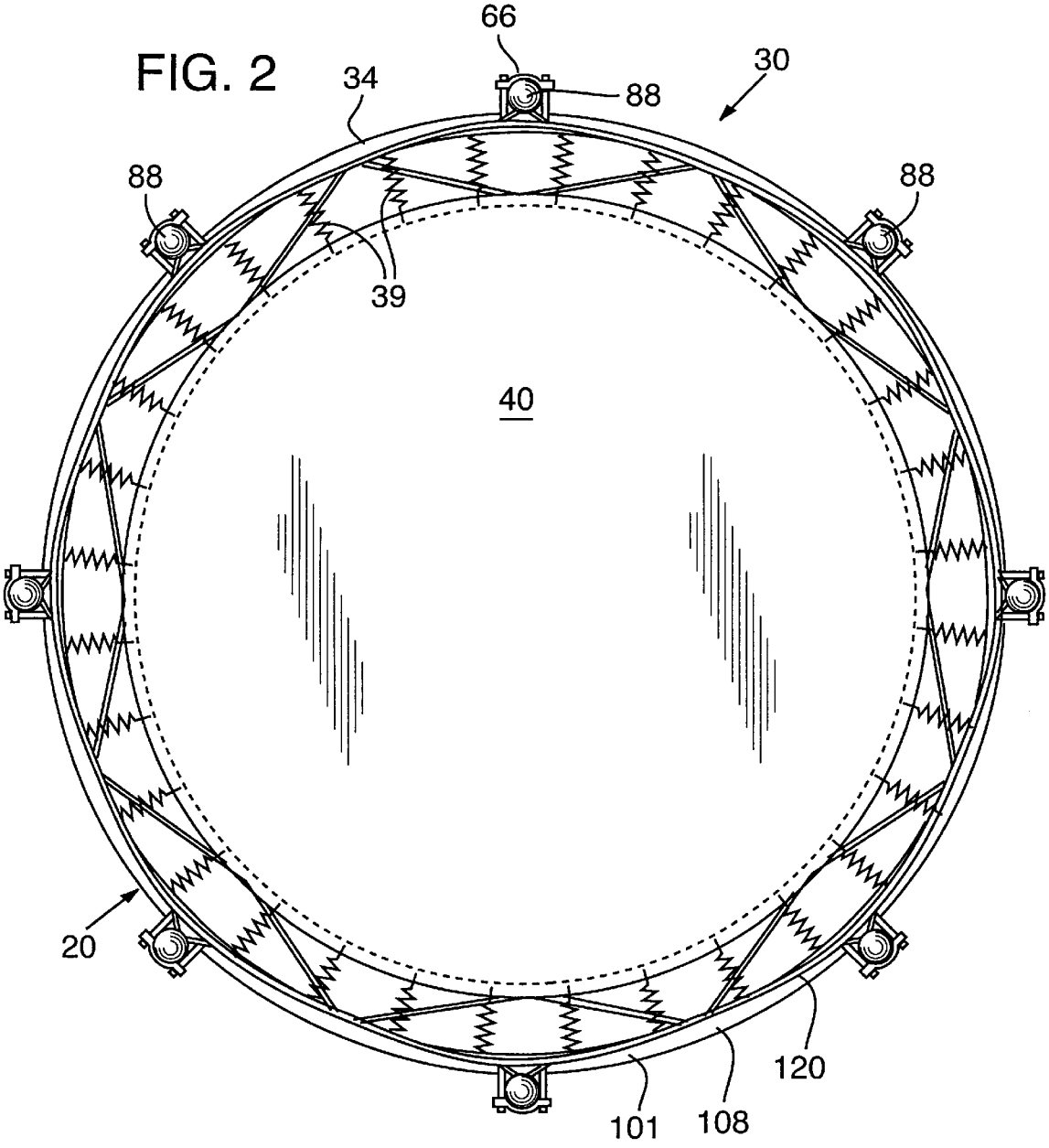
FIG. 2 is top plan view of the apparatus shown in FIG. 1.

Trampolines come in a variety of configurations and sizes. A popular trampoline 20 is shown in FIGS. 1–2. The illustrated trampoline has a circular frame 34 supported by multiple U-shaped tubular legs 36. The U-shaped legs have two vertically-extending sections 37 connected by a horizontal section that rests on the ground. The upper ends of the vertical leg sections 37 are secured to the frame 34 by welds. For ease in storage, it is convenient for the legs to be removable. This is made possible by providing a swage joint 38 in each vertical leg section 37. (In some embodiments, the legs 36 are not removable but are fixedly secured to the frame 34. In such embodiments, it is sometimes desirable to secure the legs to the ground, as by coupling to screw-in ground anchors. The coupling can be ineleastic or elastic.)

In the preferred embodiment, at least the top of frame 34 is covered with a resilient foam material to help cushion any impact against the frame. Many commercially available trampolines use 1.92" O.D. frame tubing. This can be covered by splitting 3.0" I.D. extruded foam tubing, and securing a split half on top of the frame by tape or the like.

A plurality of spring members 39 tautly attach a sheet of sturdy fabric 40 to the frame 34 so that the fabric provides a rebounding surface or bed.

Other types of trampolines, having variations in structure such as individual legs secured by bolts or the like, will equally benefit from the present invention.

The foregoing trampoline is augmented by an enclosure system 30 that provides a protective and interactive environment for a trampoline user. The illustrated system 30 includes a plurality of posts 44 which extend vertically. Each post 44 is secured to a vertical section 37 of one of the legs 36. For the purpose of this disclosure, each post 44 is referred to as having an upper end portion 46, a wall support portion 48 located above the level of the rebounding surface 40, a lower portion 50 located below the surface 40, and a lower end portion 52 which extends to ground level. These designations refer to locations on a post 44, not to separable sections. In the illustrated embodiment, each post 44 is made in two sections and connected at a swage joint 54, with the two pieces secured together by a set screw. A single-piece post can also be used, or a post comprised of more than two pieces secured end-to-end with swage fittings and set screws can be used.

A post comprised of plural telescopically-fit poles can also be used. Telescopic fitting of poles facilitates adaptation of a single fence kit to differently sized trampolines (or pools). For example, 10 foot diameter trampolines are typically 20–24 inches high, whereas 14 foot diameter trampolines are typically 33–36 inches high. End user customization of the safety fence system is required, if a single model of fence is to be employed with both sizes of trampolines. A fixed length tube (whether of constant diameter, or tapered as by swage joints) requires the customer to cut off an end of the pole to adjust the height. A telescopic (slip fit) joint permits the customer to customize the pole height by simply by coupling the tubes (whether by a screw, bolt, compression straps, etc.) to achieve the desired length. Excess length is not discarded, but rather fortifies the overlap and the strength of the resulting structure.

Figure 3:
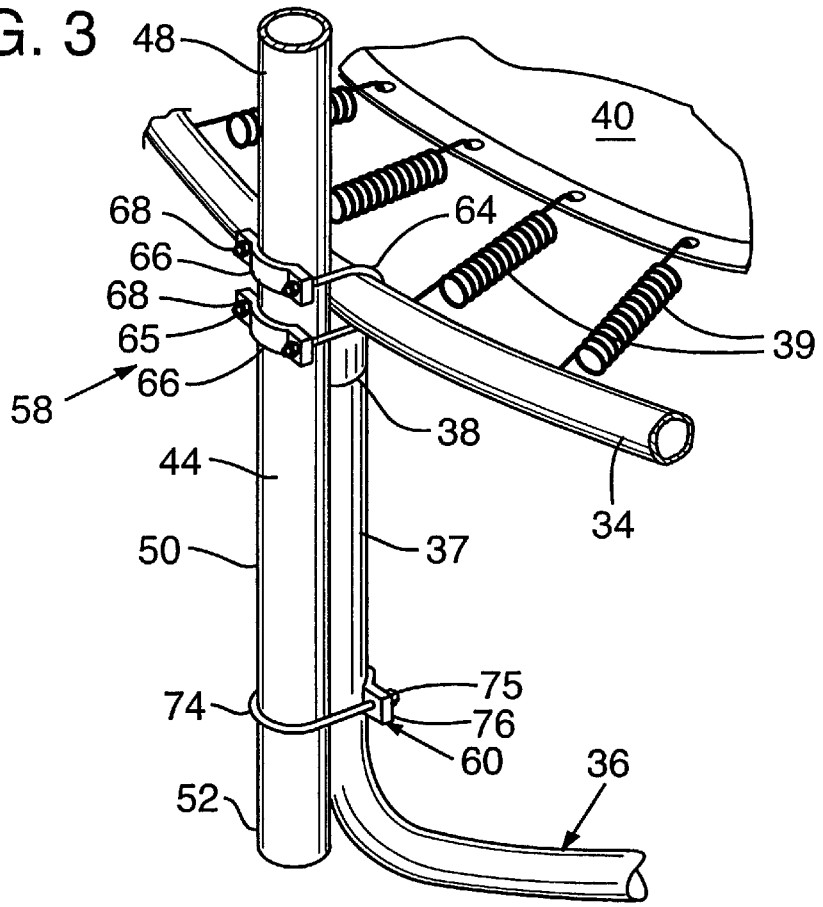
FIG. 3 is an enlarged oblique view of a leg portion of the apparatus shown in FIG. 1.

Each post is connected to a leg by two leg fasteners 58, 60. As best seen in FIG. 3, the upper fastener 58 is an assembly having two U-bolts 64. The U-bolts have threaded ends 65. In use, the U-bolts are positioned to encompass the frame 34 on opposite sides of the vertically extending portion 37 of a leg 36. Two saddle clamps 66 are respectively positioned above and below the frame 34. Each clamp 66 has two openings that respectively receive one threaded end 65 of each of the two U-bolts. Nuts 68 are tightened onto the threaded ends 65 of the U-bolts 64 in order to secure the post 44 to the frame 34. A clamp cover cap can fit over the U-bolts to hide same.

To provide a degree of flexibility in the fasteners 58, stiff compression springs (not shown) can be provided between the saddle clamps 66 and nuts 68. In such an arrangement, locking nuts are used, and the nuts are not tightened to the extent that the springs are completely crushed. With such springs in place, a post 44 can move a short distance away from the frame 34 when a person bounces against the post from inside the trampoline court of chamber 106, and the post is urged outwardly. The additional movement of the pole helps cushion the impact on the person, and helps store energy that is subsequently released to propel the person away from the fence/pole. A similar spring-coupling arrangement can be used at the lower clamp 60, there arranged to permit the top of the pole to deflect inwardly (i.e. the bottom of the pole deflects outwardly, away from the leg) when a remote part of the fence is impacted.

A rigid, smooth-surfaced cap (not shown) is provided on the outside of each upper fastener 58 to cover all the threaded ends 65 of the U-bolts. These caps protect persons from coming into contact with the threaded ends 65 of the U-bolts 64, which ends are somewhat sharp. Each cap has rounded comers and is secured in place over the ends 65 by a cable tie (not shown) which encompasses the cap and a diameter of the frame 34 and/or leg segment 37. Other covering arrangements can of course be used.

The lower fastener 60 has a single U-bolt 74 with threaded ends 75. A saddle clamp 76 is positioned over the threaded ends and held in place by nuts (not shown). For greatest stability, the lower fastener 60 should be near the bottom of the vertical section 37 of the leg 36 so that the lower fastener 60 is well below the upper fastener 58. (Alternatively, fastener 60 can attach anywhere along the horizontal portion of legs 36.) For safety, the lower fasteners should be positioned so that the threaded ends of the U-bolts 74 extend inwardly, toward the center of the trampoline bed 40. The cantilevered mounting of poles 44 allows deflection of the tops to help absorb shock impact It is particularly helpful for the fasteners 58, 60 to be positioned so that any swage joints 38 are located between the upper and lower fasteners 58, 60. This arrangement prevents the swage fittings from coming apart unintentionally, as is possible during energetic use of a trampoline for game playing. It is also an advantage of this system that it reinforces the legs of the trampoline and reduces the stresses on the welds between the frame 34 and legs sections 37.

The wall support portion 48 of each post 44 is covered with a layer of padding 84 made from a resilient foam material, with or without a fabric cover. The padding may be a rectangular sheet wrapped around the post 44 and secured by fasteners or may be tubular so that there is no seam. The illustrated foam is extruded closed cell polyethylene foam tubing, with a wall thickness of 0.625 inch. Other resilient, weather-resistant foam materials can also be used. As explained below, the foam material serves not only as cushioning for a person who impacts one of the posts 44, but also serves as a part of a system for momentarily storing energy from remote impacts, so that the foam contributes to rebounding a person toward the center of the trampoline, even when the foam is not directly impacted by the person.

In the illustrated embodiment, an end cap 86 is provided as an upper extension of each post 44. The end cap has a rounded upper portion 88, a centrally-located neck portion 90 defining a circumferential channel extending around the axis A of the post 44, and a downwardly-opening collar or sleeve portion 91 which is located at the base of the cap and which is of greater inside and outside diameter than the neck portion 90. The upper portion 88 is substantially spherical for strength. The neck portion 90 is hollow and shaped to snugly fit over the upper end portion 46 of a post 44. The collar portion 91 can be of sufficient inside diameter to receive, protect, and aid in securing the top of the padding layer 84. The cap 86 is made of a shatter-proof plastic material which is somewhat flexible at typical ambient temperatures so that the cap is capable of cushioning some impact energy.

A hook 92 is provided by an eye bolt having a passageway 93 giving access to the center of the eye. In the illustrated embodiment, the hook is located on the end cap 86, but can be located elsewhere at or near the upper end portion 46 of the post 44. The eye bolt has a shank that extends through two vertically-aligned, registered holes through the post 44 and cap 86 at one side of the post 44. The threaded end of the shank is secured by a tee nut 94 which has a neck received in suitably-sized, registered holes through the post 44 and cap 86 at the opposite side of the post 44. Other forms of hook can be used at this location, and a hook can be secured differently, for example by one or more clevis pins extending both through a portion of the hook and through the post. A closed eye could also be used, but this would be less convenient because certain lines are threaded through eyes during installation of a wall. The hook has several uses explained below.

A generally cylindrical wall 100 of a flexible material is suspended between the posts 44 to define a chamber 106 above the rebounding surface 40. The illustrated chamber is open at the top as shown in FIG. 1 (although in other embodiments this may not be the case). The wall 100 has top and bottom edges 101, 102 and is made of a light-weight plastic sheet material, such as extruded plastic safety fencing, having a unitary structure with numerous mesh-like openings 104. Woven netting, strong fabric, or other forms of plastic mesh may also be used, preferably with the top and bottom edges 101, 102 being reinforced by a hem or other finishing. Generally, the wall material will be a rectangular piece having a width which is the same as the height of the wall, and a length which is somewhat longer than the circumference of the enclosure. The openings should be no more than 2 inches across, in their largest dimensions, to prevent small children from getting their hands stuck in the openings and so that there is a sufficiently uniform surface against which balls of most any size can be thrown during game play. Preferably the openings are at least 1½ inches across and spaced sufficiently close that there is good visibility through the wall 100. The fencing may take many forms; the most common have patterns of openings that are diamond-shaped or rectangular. The most preferred fabric for the wall 100 is an extruded monofilament polypropylene netting in which the nodes and strands are rounded/oval, with smooth transitions in order to reduce the chance of cuts/abrasions to the users (and to structures to which the fabric is secured). This fabric and the other nonmetal elements described herein are best made of materials that are both abrasion-resistant and are resistant to weathering, e.g. by exposure to UV light. Suitable materials generally include polypropylene, nylon, high density polyethylene, and Dacron polyester.

A support system is provided to hold the wall 100 in place. At the top, a flexible line 108 extends post-to-post near the top of the chamber 106. Each pair of adjacent posts 44 is coupled by a reach of the line 108. In the illustrated embodiment the line 108, although flexible, is only somewhat elastic. The line 108 thus allows the tops of the poles to move relative to one another, but the tops of two adjacent poles can not move away from each other to any great extent. The line 108 is made of a sturdy, weather-resistant material such as 1" nylon webbing. Nylon webbing has little elasticity and thus will not sag after it is installed. Webbing is better than rope for line 108 since rope has a relatively low surface area which would tend to cut into and abrade the body of a person who bounced into contact with the line 108. Webbing has a relatively high surface area and automatically rotates so that a flat face of the webbing contacts any impacting body. The flat webbing face distributes resistive force over a greater portion of a person's body and is relatively nonabrasive.

Figure 7:
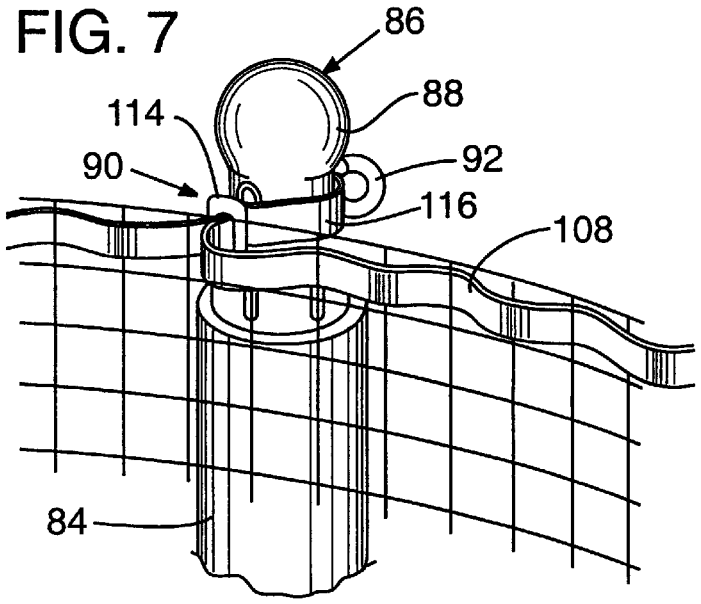
FIGS. 6 and 7 are enlarged views of an end cap used in the FIG. 1 embodiment.
Figure 4:
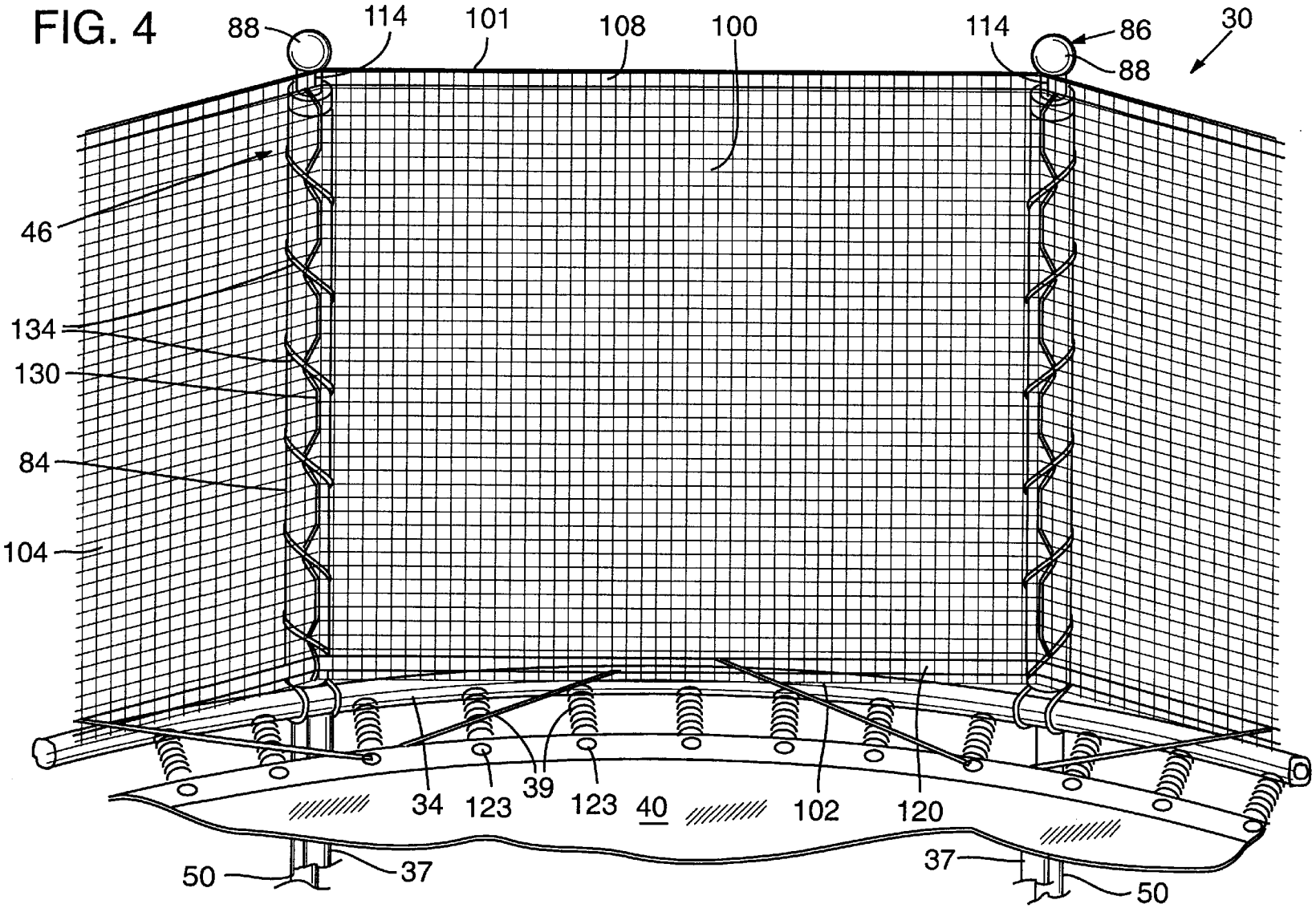
FIG. 4 is an enlarged partial oblique view of a wall portion of the apparatus shown in FIG. 1.

The illustrated top line 108 is a single continuous piece. The ends of the top line 108 are secured together by a buckle 110 so that the top line forms a continuous loop. This is a strong construction since the buckle 110 is the only fitting connected to the line. Tension in the line 108 can be adjusted by using the buckle 110 to vary the circumference of the loop. The line 108 is mounted to chokingly surround the neck portion 90 of each end cap 86. In one embodiment (FIG. 7), this is accomplished by slipping a loop 116 of the line 108 through a metal ring 114, and then lowering the loop 116 over the top 88 of the end cap 86 to a position where the loop 116 seats in the trough of the hook 92 and extends through the neck portion 90. After the line 108 is thus installed on all the end caps and pulled to a desired tension, each ring 114 maintains its loop 116 at a small diameter so that the loop 116 can not slide up out of the neck portion 90. The ring 114 is a welded steel chain link having inside dimensions of 1"×⅜" and having rounded edges to minimize wear of the line 108 and to protect trampoline users from injury.

Figure 5:
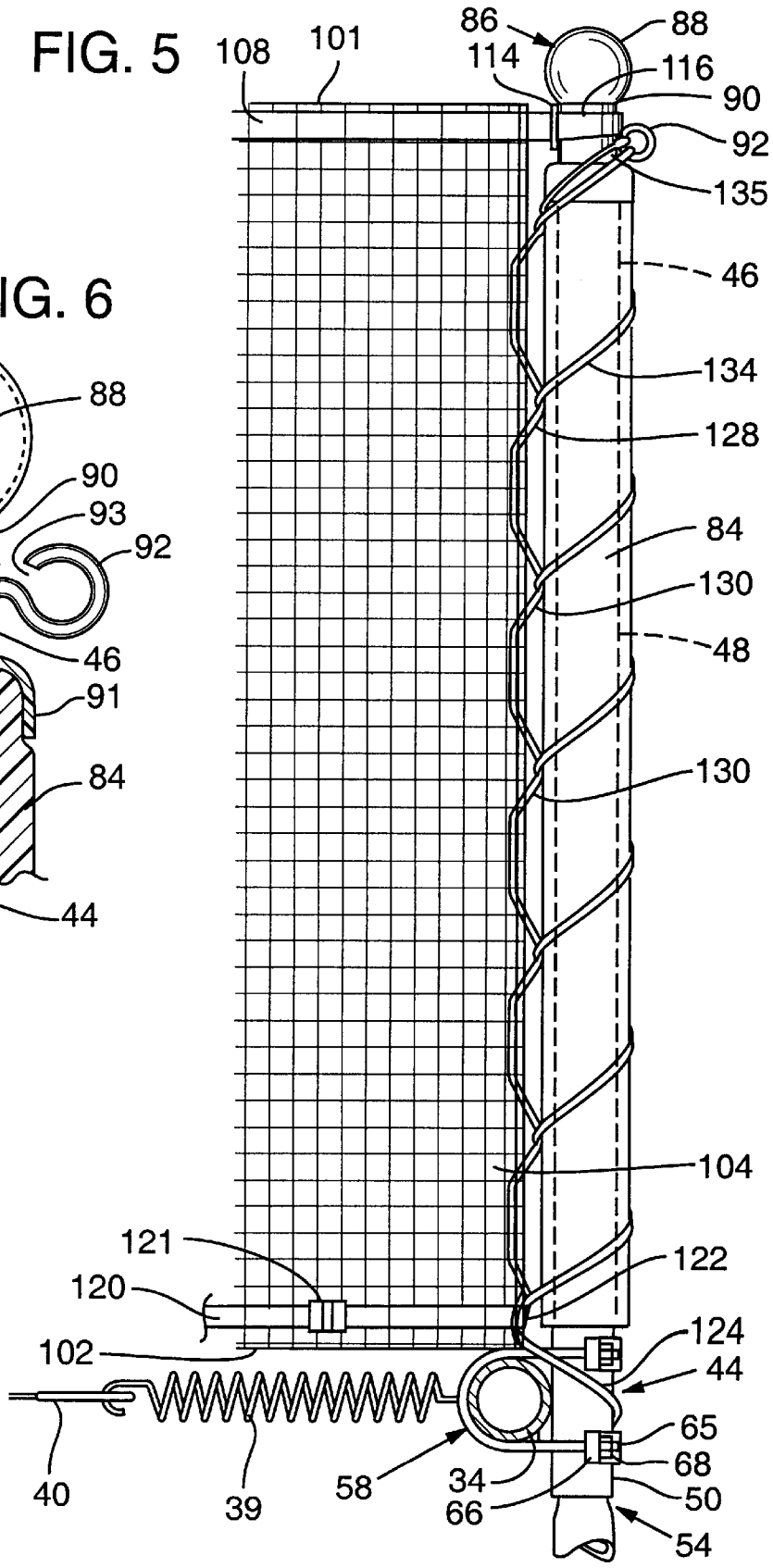
FIG. 5 is an enlarged partial side view of the apparatus shown in FIG. 1.
Figure 6:
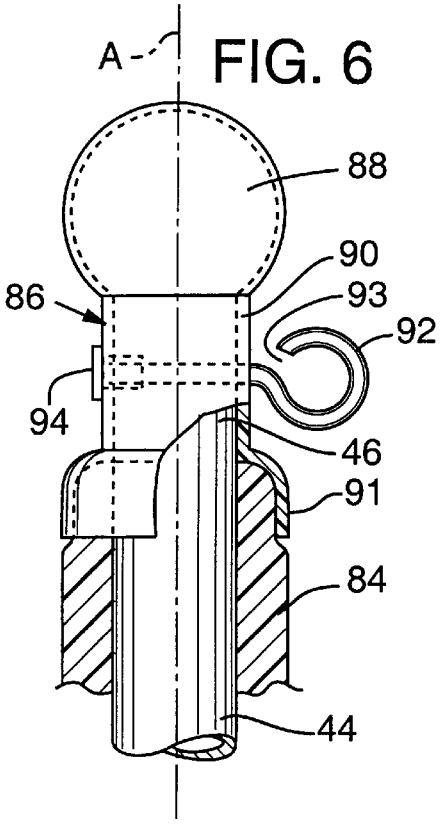

The wall 100 is secured to the upper line 108 along portions thereof extending between the posts 44. This can be accomplished in a variety of ways. When using mesh-like plastic safety fence having numerous openings 104, it is most convenient to weave the upper line 108 through a series of openings 104 near the top edge 101 of the wall 100. This arrangement is shown in FIG. 5. The weaving can skip a few openings 104 opposite each of the end caps 88 to reduce stresses at points where the top line 108 extends from the fencing to a post 44.

A similar arrangement is used to secure the bottom edge 102 of the wall 100. A strap of one inch polypropylene webbing 120 extends post-to-post at an elevation near that of the frame 34. A reach of the webbing 120 thus extends between each pair of adjacent posts 44. The webbing additionally can be secured to the frame 34 at intervals between the posts 44, by cable ties (not shown) or other fasteners, to prevent the wall from stretching to a position outwardly of the frame 34.

The ends of the webbing 120 are secured together by a buckle 121 so that the webbing 120 is a continuous loop. Tension in the webbing 120 can be adjusted by using the buckle 121 to vary the circumference of the loop. With a wall of inelastic netting, the webbing 120 can be woven through a series of openings 104 near the bottom edge 102 of the wall material. (If the webbing were fixedly attached, as by sewing or the like, the differences in elasticity between the plastic netting and the webbing would lead to premature failure of one component or the other. The illustrated free-weaving arrangement allows the two components to move somewhat independently, yet conform to the forces that each places on the other during an impact.)

At each post 44, a loop 122 of the webbing 120 extends out from the wall 100 and is held to the post 44 by a fastener 124 such as a cable tie, or by passing through a link of a short chain secured to one of the U-bolts 64. The fastening should be arranged so that the loop 122 cannot move a substantial distance upwardly along the post 44. A loop 122 should not extend from two immediately adjacent openings in fencing material, since this would stress the fabric near the post. Instead, some space should be allowed between the two points where the loop 122 extends from the wall 100, so that tensioned webbing 120 does not cut into the wall 100 at those points. As an alternative, the bottom edge of the fencing 100 can be secured directly to the frame 34 by a series of cable ties (not shown), without use of webbing 120. Connections between the fence 100 and the frame 34 can be threaded through openings pierced through perimeter padding 126.

The just-described arrangement places the fence 100 beyond the extent of the rebounding surface. That is, the bottom diameter of the chamber 106 is larger than the diameter of the rebounding surface 40. In an alternative arrangement, the fence is arranged to encompass a smaller area. In such an embodiment, the netting can be secured to the edge of the rebounding surface, as by weaving the webbing 120 through eyes or loops 123 along the margin of the rebounding surface (to which the springs 39 attach), or to the inner ends of springs. In some embodiments, the netting is not be affixed to the support posts 44 except at their tops. Instead, the netting extends down from the top line 108, and is secured only to the periphery of the rebounding surface 40. In such embodiments, impacts to the netting are quickly transferred to the elastic rebounding surface.

Alternatively, instead of coupling the netting to the margin of the rebounding surface 40, or to the inner ends of the springs 39, it can be coupled to an inner portion of the annular pad 126 that is commonly used to cover the springs (e.g. to holes formed therein, optionally reinforced with grommets).

Instead of using webbing 120 as the coupling member at the bottom of the netting, cable ties, elastic cording, other webbing, etc., can alternatively be used. In still other arrangements, no discrete coupling member is employed, but the fencing is directly coupled to an element of the trampoline (e.g. springs 39 can be passed through openings 104 near the bottom margin of the fence.) In some such embodiments, the bottom margin of the netting may be positioned below the plane of the rebounding surface.

By arrangements such as the foregoing, the fence is constrained in size so as not to encompass any part of the frame within chamber 106. Desirably, the fence does not extend much—if any—beyond the rebounding surface itself. In some such embodiments, the annular pad 126 can be omitted except in a gangway region, since the fence will prevent user impacts against the springs 39.

Desirably, wall 100 is secured to each post 44 along its vertical length by an arrangement that includes one or more elastic components. As best seen in FIG. 5, an elastic cord 128—of the type sometimes referred to as a bungee cord or shock cord—is secured at each end so that it extends vertically along the wall support portion 48 of a post 44. In the illustrated embodiment, cord 128 has loops at each end. The cord is wrapped once around the trampoline frame 34 near the post 44, and one end of the cord is drawn through the loop at the other end, securing the cord to the frame. At the upper end, the loop of cord 128 is passed over the top of the end cap and rests in neck portion 90 and in the opening 92 of the eyebolt. (Various other terminal attachments for cord 128 can of course be provided.)

Between its ends, cord 128 extends in serpentine fashion through openings 104 in the wall material so that loops of the cord 128 are alternately provided on the inside and the outside of the wall 100. Outside loops 130 of each cord extend towards the post 44. Also extending along the wall support portion 48 of each post 44 is a helical wrap of webbing 134. In the illustrated embodiment, this webbing is a length of one half inch polypropylene webbing fixedly secured at each end. At the top end, webbing 134 is secured to the post (e.g. to eye bolt 92). At the lower end, the webbing 134 can be attached to various fixtures, such as the post 44, an eye-bolt therethrough, the frame 34, the clamp 58, the trampoline leg 37, etc. Webbing 134 extends helically around the outside of the padding 84 and through loops 130 in the elastic cord 128 to hold the cord against the padding 84. The strap 134 is wrapped sufficiently tightly to hold the cord 128 against the padding 84, but not so tightly that the padding is substantially deformed. Elasticity of the loops 130 helps to prevent the wall fabric from ripping under impact loads.

Figure 8:
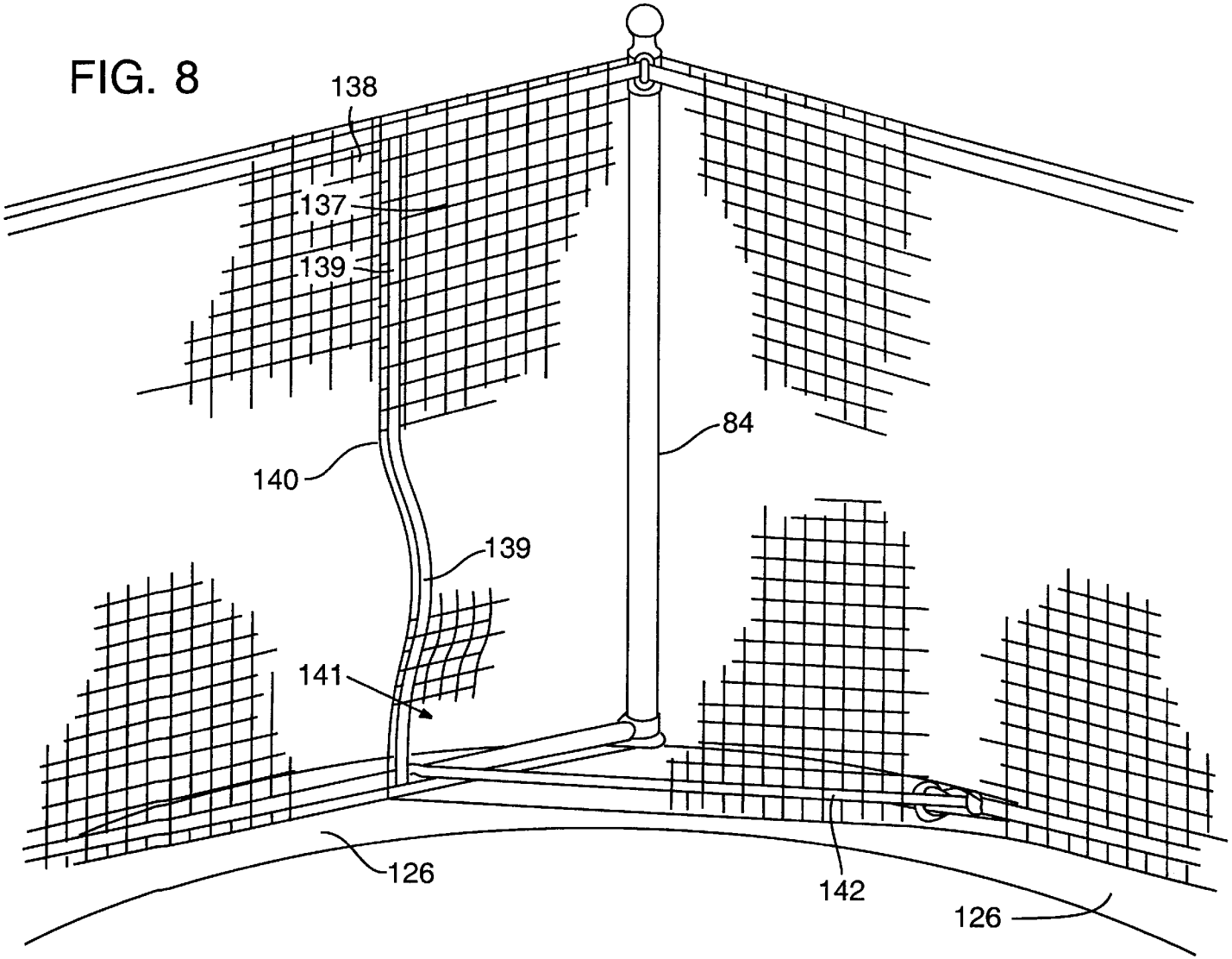
FIG. 8 illustrates a door structure used in the FIG. 1 embodiment.

Because the wall material 100 is longer than the circumference of the enclosure, ends portions 137, 138 of the wall fabric overlap as shown in FIG. 8. At the top, the end portions 137, 138 are secured by weaving of the line 108 through openings 104 at the top edge of the end portions. A horizontal row of openings at the tops of the two end portions 137, 138 are held with the openings in registry, and the line 108 is threaded through adjacent openings in the rows, in serpentine fashion, so that the top edges of the end portions 137, 138 are in effect sewn together by the top line 108. At the bottom, the outer end portion 138 is secured by weaving of the line 120 through openings 104 at the bottom edge of the end portion. The bottom of the inner end portion 137 is not secured. A piece of ½" nylon webbing 139 is woven in serpentine fashion downwardly from the top line 108 through both the end portions 137, 138 to a location 140 between the top and bottom lines 108, 120. This webbing 139 thus sews upper regions of the end portions together. The nylon webbing continues down from the location 140 secured only to the inner end portion 137. Thus the end portions 137, 138 are not sewn together below the location 140, thereby providing a flap door 141 which can be bent inwardly to permit access to the chamber 106. A free extension 142 of the webbing 139 can extend from the bottom of the inner end portion 137 to be used for tying down the bottom of the door. In the illustrated embodiment, the extension is secured by wrapping it around the bottom line 120 at the base of the door and then tying it to a removed area of the bottom line 120. Desirably, the overlap and securing arrangements are such that—even if left unsecured—the flap will not permit a jumper to fall off of the trampoline.

If desired, the flap door 141 can be secured by a locking device, such as padlock, holding the flap immovably to another part of the structure (which may be the overlapping netting), thereby impeding access to the trampoline surface. In one embodiment, an elongated metal cable with eyelets at the end (as is commonly used for locking bicycles) is threaded along the length of the open flap and is used in conjunction with a padlock, so the flap is secured at more than a single point.

The illustrated enclosure system has walls that are strong but highly resilient. As noted, the fabric of the wall 100 is extruded plastic safety fencing that is flexible, but only somewhat elastic. In the illustrated embodiment, elasticity is provided by other elements. In particular, the cord 128 is elastic, the padding 84 is comprised of a plastic foam material which compressible and elastic, and the posts 44 are somewhat flexible. In other embodiments, the wall fabric itself can be elastic.

When a person jumps from the trampoline surface 40 and hits the wall 100 of the enclosure, the wall moves a short distance in the direction of the force applied by the user and thereby absorbs energy and cushions the shock. The tops of all the posts 44 in the illustrated embodiment—because they are linked together at the top by the top line 108—flex toward the impacted portion of the wall panel. Cord loops 130 are stretched on those posts 44 that are near the region of impact. And, those loops 130 pull and tension the associated strapping 134 into the padding 84 so the padding compresses. These actions allow the fence 100 to flex and conform to the body of the person who impacted the fence. The conformance of the fence distributes the resistive force on the person's body to provide enhanced cushioning. Also, because of this arrangement of elements, a portion of the impact energy is stored in the flexed posts 44, in the elongated cords 130, in straps 108 and 120, and in the padding 84. (Impact energy may additionally be stored in the rebounding surface, if the netting is connected thereto.) This stored energy is promptly released as a reaction force that urges the impacted portion of the wall back towards the center of the chamber 106, pushing the trampoline user with it.

In embodiments in which the bottom of the netting is attached to the periphery of the flexible rebounding surface 40, the system can be conceptualized as an arrangement of upright long tubular springs attached to a diaphragm that helps disperse, absorb, and re-cycle impact forces directed at the poles and the net. The diaphragm also transfers these forces to the support system that maintains the diaphragm's elevation. The tubular springs (posts) can be loaded by tightening line 108, pulling the tops of the tubular springs downwardly and inwardly. Such arrangement makes the system tighter/less flexible, so that impact forces from a focused strike point transfer more quickly to the entire system than would be the case if the top line were loosened. If the line is loosened, the tubular springs are unloaded and are provided more space to flex, thus delaying transfer time and making any impact with the net feel softer—an arrangement generally preferable for light individuals. Loading the tubular springs (posts) in this way works on the same principle as loading a bow for the purpose of shooting arrows. If the posts begin to fatigue over time, the top line 108 can be tightened to compensate for this increased flexibility (and the net adjusted or trimmed as necessary).

In order to provide the above-described spring effect, the posts 44 should not be rigid. The posts should be sufficiently strong that impacts by trampoline users will not permanently bend the poles. But, the posts 44 should be able to flex to some extent when a trampoline user impacts the wall 100. For ease of construction and low cost, the illustrated posts 44 are made of tubular steel. Other materials, such as PVC, plastic, fiberglass, graphite, carbon fiber, Kevlar, etc., can be used if they have appropriate strength and flexibility characteristics. The particular material(s) can be selected to tailor the flexibility, elasticity, and strength of the resultant system as desired. One alternative embodiment employs a fiberglass second (upper) pole with a steel first (lower) pole. Another alternative embodiment employs a heavier gauge stronger steel first (lower) pole, in conjunction with a lighter, more elastic steep second (upper) pole.

In systems employing telescoping poles, varying the overlap between poles—as well as varying heights of the pole and/or overlap off the ground—allows the posts' flexibility to be tailored as desired. For example, enlarging the overlap region, or extending it further above the trampoline, stiffens and strengthen the system for heavier or taller individuals, whereas mounting the overlapping region below the trampoline frame adds flexibility for lighter individuals.

Figure 9:
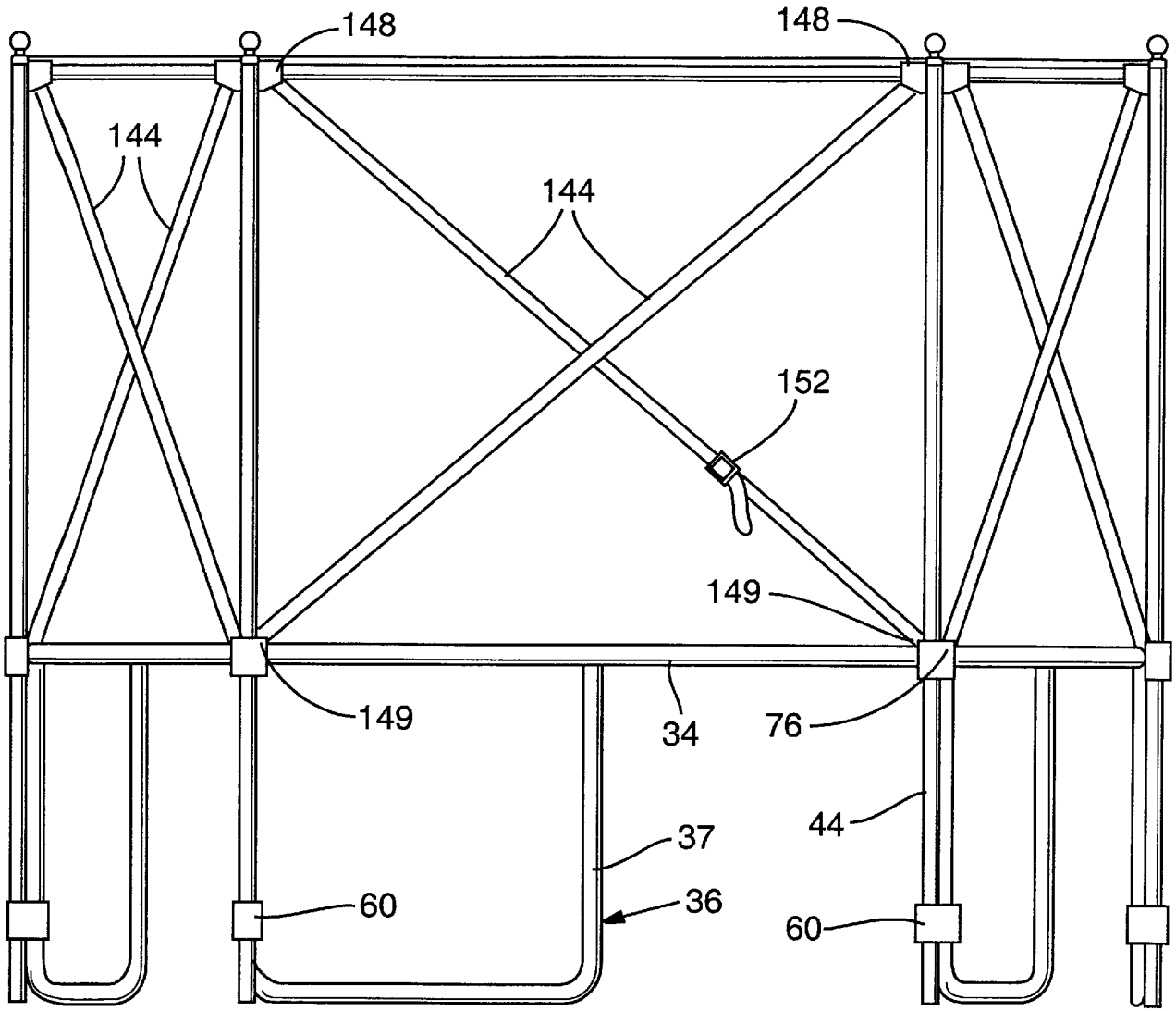
FIG. 9 shows cross-bracing that can be used in the FIG. 1 embodiment.

As most clearly seen in FIG. 9, cross-bracing straps 144 can be provided to limit the movement of adjacent posts 44 toward or away from another. A preferred cross-bracing material is substantially inelastic nylon webbing; plastic or metal cable could also be used. The cross-bracing extends, in pairs of crossing reaches, from positions near the upper end portions 46 of two adjacent posts 44 to positions which are near the elevation of the frame 34, so that an X-shaped pair of straps extend between each pair of adjacent posts 44. The cross-bracing for a pair of adjacent posts 44 can be provided by a single length of strapping which extends in a partial figure-eight pattern among four rings including a top ring 148 and a bottom 149 on each post. The two ends of the strap 144 are secured by a buckle 152.

It is possible to tune the flexibility of various elements of the enclosure system. This can be done in various ways. For example, tension springs, such as shock cord segments, can be added to (or wholly substituted for) the line 108, the strap 120, the strapping 134, and/or the cross bracing 144. The addition of a short section of flexible cord imparts a small amount of elasticity to such members. For greatest adjustability, such a member can be constructed from a series of short runs of inelastic webbing, instead of from one continuous run. Tuning can also be accomplished by changing the width of the helically wrapping strap 134 that passes shock to the padding 84 on posts 44, and by changing the diameter of the elastic cord 128. The netting configuration (e.g. diamond versus square openings) also affects the rebound characteristics, as does the choice of net material (e.g. nylon netting is relatively more elastic than plastic). As noted earlier, choices associated with fence support posts 44 also provide many opportunities to tune the fence's rebounding characteristics.

In the preferred embodiment, the fence serves as more than a passive safety restraint, but rather forms another rebounding surface. That is, the fence serves to store, and subsequently return, a substantial percentage of any impact energy, thereby propelling a jumper back onto the horizontal trampoline surface. Although there are no standardized metrics in the industry, one useful measurement is the percentage of energy returned to a substantially inelastic 100 pound object that horizontally impacts the fence netting at a location midway between the upright support poles, and midway up the height of the fence ("horizontal rebound factor"). Desirably, the horizontal rebound factor is at least 10%. By suitable selection of netting and support materials, and tensioning of the adjustable members, significantly higher horizontal rebound factors can be achieved, such as 20%, 30%, or 40%, or more.

(It will be recognized that the illustrated fence responds to such mid-span horizontal impacts in a manner different than prior art safety fences. In particular, the tops of the posts flex downwardly towards each other and towards the area of impact (just like loading a bow for shooting arrows, as noted earlier). This effect makes it possible for the fence system to conserve more of the impact force energy in the posts, enabling the system more efficiently to recycle this energy back into the impacting body for the purpose of returning it to the trampoline surface. Top line 108 serves as the primary mechanism for transferring such loads between the posts. The freedom of motion afforded by line 108 enables the net to more completely conform to the surface of an impacting body, distributing the forces of impact over a larger surface area on the body, thereby reducing the likelihood of injury.)

While the foregoing embodiment employs a post 44 extending upwardly from each trampoline leg 37, this need not be the case. In one alternative embodiment posts 44 extend up above every other trampoline leg. Thus, the number of posts 44, and where they are mounted, will depend on the size of the trampoline and the number of its legs, and the preferences of the trampoline owner. But, using the same basic set of parts, an enclosure kit can be assembled for trampolines of almost every size and shape.

The foregoing discussion contemplates that the safety fence is provided as a retrofit accessory for a trampoline (or pool), and includes hardware for securing the fence and trampoline together. Naturally, the fence can alternatively be included as an integral part of the trampoline assembly. Such an arrangement has certain advantages, including reduced cost and complexity. For example, the twin tubes 50, 37 extending to the ground (FIG. 3) can be replaced by a single leg, and the coupling hardware used to couple the tubes together can be replaced with other (typically simpler) hardware—or dispensed with entirely.

In one such embodiment, the legs that position the rebounding surface above the ground also extend above the trampoline surface to provide support for the safety fence components. In another embodiment, arched fence supports extend up from between adjoining trampoline legs, and are linked to the other arched fence supports. (Due to shipping concerns, all such elongated structures are typically provided in several parts and assembled in the field by the customer.)

As will be recognized by the artisan, numerous modifications and additions (and deletions) can readily be made to the above-detailed embodiments while maintaining the same general structures.

For example, there are many alternative methods for securing the top line 108 to the posts 44. One is to wrap the line 108 once completely around the next 90 of the end cap 86, so as to slidably engage the line with the post without use of a ring 114.

The attachment of the wall to the posts can be different. Although not preferred, the wall fabric can be attached to the posts with cable ties. Or the wall can be secured directly to the support with a helical wrap (e.g. elastic bungee cord or inelastic nylon webbing), without an intermediate cord (e.g. bungee cord 128). In still other embodiments, the fence can be sewn to provide tubular vertical pockets into which the posts 44 are simply received. The vertical pockets can be formed a distance away from the cylindrical wall, with the intervening space reinforced by vertical nylon webbing.

In still other embodiments, the net can be positioned outside the posts 44, rather than inside. The helical webbing 134 and bungee cord 128 can be omitted in such embodiments, with less effect than in the earlier-detailed embodiment. An impact to the fence at one spot tensions the fence around its entire circumference, compressing the foam padding 84 on all the posts.

Still further, the net can be suspended inside one pole and outside the adjacent poles, or in other in/out configurations, depending on the particularly impact absorption requirements desired.

Figure 10:
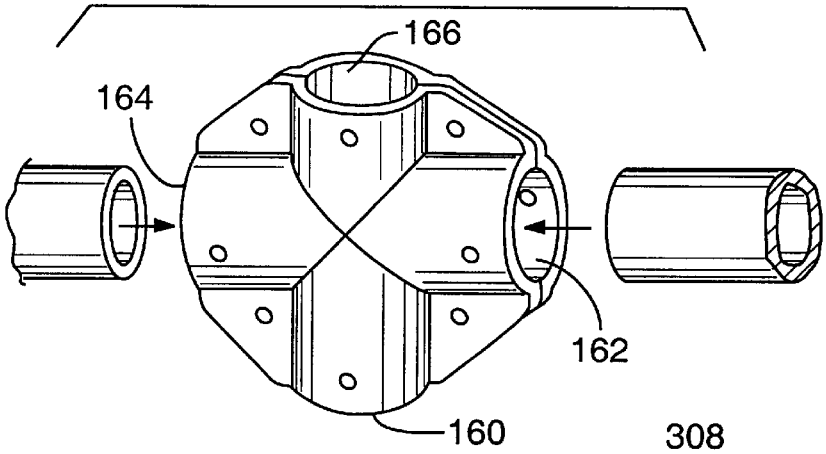
FIG. 10 shows one of several alternative arrangements for fastening upright fence support posts 44 to the trampoline frame 34.

Suitable wall-support posts can be mounted so that they extend upwardly from a trampoline frame, and do not extend to the ground. A bracket for this purpose is shown in FIG. 10. With this system, a trampoline support leg is received in the downwardly-facing opening 160, the trampoline frame is received in the horizontally-facing openings 162, 164, and the wall support post is received in the upwardly-facing opening 166. The bracket can be designed to receive free ends of four separate tubing members as illustrated. Or, a passage way can be provided through the bracket, horizontally and/or vertically, so that the bracket can be secured at a location between the free ends of a tube. For example, if the bracket has a vertical passageway, a single tube can extend through the passageway and, if the tube is sufficiently long, be used for both the trampoline leg and the wall support post (e.g. in an integrated trampoline/fence arrangement). Likewise, if there is a horizontal passageway, the bracket can be secured to a frame segment at a location between the ends of the segment. The bracket shown in FIG. 10 is made of two sheet metal members that bolt together to sandwich tube members therebetween. Other suitable brackets are metal cross connectors of the type used in plumbing joints. Myriad other such variations will be apparent to the artisan.

In still other embodiments, the fence poles can be coupled to the frame or leg of the trampoline by one or more lengths of elastic cording, e.g. with a "figure-8" wrap (particularly suited for coupling a pole to the frame). A loop in one end of the cord, and a ball at the other, can be engaged to secure the cord in place. Stout rubber "O" rings can alternatively be employed. Non-elastic cable or zip ties, or hose clamps, can be provided as coupling elements, with elasticity provided (if desired) by cushioning inserts (e.g. resilient foam or rubber) inserted between the cable ties and the associated pole/frame/leg.

In yet other embodiments, a post can be coupled to the frame of the trampoline by an elongated metal or plastic member having an opening at each end sized to receive the post. The member is bent around the trampoline frame so the two openings are in alignment, and the post is passed therethrough. Slippage of the member (and thus the frame) down the post can be prevented by various securing arrangements, including a bolt, a swage joint to a larger tube, etc.

In still other embodiments, the post can be passed through two eye bolts, one positioned above, and one below, the trampoline frame. On the inside of the frame, the threaded ends of the eye bolts can pass through a rigid (e.g. metal) or resilient clamp saddle, and be secured by nuts.

In yet other embodiments, it is possible to position the posts 44 inside the frame 34 of the trampoline using variants of the above-described arrangements.

In some embodiments, it may be impossible or undesirable to connect the fence support posts to the trampoline legs. In such embodiments, the posts can be secured in place by the ground (as in a hole), or in a can or the like mounted to the ground and sized to receive the post. (The can or hole may be positioned as necessary to achieve an inclined support post, if desired.) Excess space in the can/hole may be filled by various media, either resilient (e.g. rubber), fixed (e.g. concrete), or intermediate materials (e.g. rock, sand). Such arrangements permit myriad variations in pole placement and orientation.

The protective caps 86 on the ends of the fence poles can have various forms. For example, a domed cap can be used, manufactured of a somewhat soft material to dampen impacts, while still providing protection from the top end of the support pole. The cap can be filled with foam or caulk for increased shock absorbency. The cap can also be provided with an accordion-type wall configuration, to enhance its shock absorbing ability. The size of the cap can be increased, to enlarge the surface area that an impacting body hits, and the cap can be bent (typically outwardly) to provide more ready deformability. Combinations of the above-described end caps are similarly advantageous.

The top strap 108 can be attached to the fence post tops by arrangements different than that described above. For example, two vertically-spaced bolts (or a U-bolt) can be used at the top of each pole to position a plastic or metal keeper strip, mounted on stand-off bushings. The strap can freely slide under the spaced-apart strip. (Or, the stand-off bushings can be eliminated, and the bolts can be tightened to pinch the strap under the strip, holding it fixedly in place.) Similarly, a bracket can fit, or be bolted, onto the top of a pole and define one or more slits through which the strap can be passed. Various cam arrangements can be used to permit the strap to slide through a slitted fixture on the top of each post, until a cammed lever is pressed down, locking the strap in place.

Games

Various new games have been developed to make use of the features of the enclosure system of the present invention. These games in some instances employ accessories to the basic enclosure system, as described below.

Tramp Chase. Players start in diagonal quadrants. At least two elastic cords are stretched across a court, and hoops or other obstacles may be attached to them. (Cords—although generally utilitarian—are herein considered to be game accessories.) Someone says go, and the players race around in the same direction, either over or under each of the cords, as the players have determined. A player wins by catching to and tagging the opponent.

Tramp Ball. Players are on either side of the net stretched across the court. The net is placed higher for more challenge. The ball is soft Nerf-type about the same size as a soccer ball. Players throw or hit the ball over the net. If an opponent misses the ball and hits the back-most panel of the court, a point is scored. The opponent has one bounce of his ball on the trampoline or less to catch ball and throw or hit it back to the other side.

Tramp Shot. Two bungee cords are stretched across the court, one high and one low, and suspend a target. The target consists of three disks that may rotate. A small, soft, bouncy Nerf-type ball about 4 inches minimum is used. Players may move anywhere in the court. A player serves by hitting the ball at the target. If it misses, the opponent gets a point and the serve.

Tramp Back. Players start anywhere in the court. The target is a large (3' diameter) plastic disk mounted securely against one pole. The ball is small, soft, and bouncy but lightweight, pneumatic-type plastic ball, about 4 inches in diameter. Players may move around in the court. One player serves by hitting or throwing the ball against the target. The opponent has one bounce of the ball against the trampoline to catch the ball, and may only take one step before throwing the ball back at the target.

Tramp Scotch. Many cords are crisscrossed across the court at the same or varying heights. Players must jump over one square to another in a player-determined sequence. For more challenge, players may not touch any of the cords when making the jumps.

Tramp Pass. Two circular targets (3' in diameter) are securely attached to opposing poles in the court. Each is covered with the hook side of Velcro fastening material. A small, soft, medium-weight ball is covered with Velcro loop fastener. A cord along the surface of the tramp separates the two players. Players throw the ball at the opponent's target. The opponent tries to block or catch the ball. A point is scored if the ball sticks to the target. Once the opponent has the ball, he can throw the ball at the other target. For more challenge use more balls.

Tramp Tag. Three to eight balls of varying or equal size and bounciness are used. Players bounce about the court in any direction. They start with 10 balls losing one each time a ball touches them. The last player left with a ball wins. Once a player is out he leaves the court. For more challenge, use elastic cords stretched across the court obstacles.

Tramp Basket. A cord is stretched across the court at below waist height. A small basket with a net is securely attached to a support pole. A soft, bouncy Nerf-type ball that can easily pass through the net is used. Players either take turns a predetermined number of times and the one with the most baskets wins or a half-court game can be played. In the half-court game, the player on offense shoots behind the cord. The player on defense may not goal tend. In some embodiments, the rim of the basketball basket is spring-loaded, permitting it to defect if hit.

In some embodiments, a traditional basketball hoop/backboard assembly can be mounted between the tops of two adjacent posts 44. However, rigid coupling of adjoining posts reduces the advantageous effects associated with independent mobility of all the posts 44.

Tether Tramp I. A ball is suspended from above the court by a bungee cord. A cord also extends from the top cord down to a cord across the bottom. The ball is a medium-sized, bouncy, light-weight, plastic ball. Each player is in one-half of the court as marked by the lower cord, and remains there the entire game. A player wins by hitting the ball until it wraps tightly and completely around the vertical cord suspended in the center of the court.

Tramp Duel. Two nets are securely attached to poles located across from one another. One cord runs across the court at below waist-height, dividing the court into two halves, with the nets at the back of each. The ball is medium-sized and soft. Each player remains in his half during the entire game. Points are scored when a player makes a basket. The defender may block a shot, but may not goal-tend.

High Tramp. A cord is stretched across the net, starting out at waist height. Just like the High Jump, each player attempts to jump over the cord from one side to the other, without touching the cord. Each player gets three attempts to jump each height. If both succeed, the cord is raised. The player to make the greatest height wins.

Tether Tramp II. Similarly to Tether Tramp I, the ball is attached to a cord which is suspended from an overhead cord. The object is to throw the ball around the horizontal cord. Each player tries to wrap up the ball in opposite directions.

Tramp Touch. A cord is stretched across the court. From it, balls are hung at graduated heights. This allows small children the challenge of jumping up and hitting them at progressively greater heights. They can see if they really did touch or not because the ball will be swinging. (For younger children, the balls can be marked with ABCs, numbers, animal shapes, words, etc.)

Tramp Throw. Cords are stretched in a grid across the top of the court. The game is played by jumping up through a certain square and throwing the ball down through another specific square.

Tramp Slide. Each player attempts to slide one of two soft "buoys" across to the other side of the net. If it hits the other side without the opponent blocking it, the player scores a point. For additional challenge, a cord separating the two buoys for both players can be added. This requires the players to jump over the cord to get between the two buoys.

Tramp Hook. Each player has a different colored set of "hooks." A grid at the top of the court is divided into different sections, and they score by putting their hooks in their color-coded spot for each section. Each player is in a separate section, and they rotate when one completes his section.

Tramp Jump. An ordinary garden hose is attached to a water-pressure driven motor suspended in the center of the court. Attached to the motor is a soft rubber foam rod with a soft weight at one end. The motor turns the foam rod around the court, and the exiting water splashes around the court. Players avoid the foam rod by jumping or ducking. Its height may be varied.

WaterPlay. A garden hose is routed up a post 44, and secured near the top. One or more loose lengths of hose extend from the secured hose termination out over the rebounding surface. These lengths flap around under water pressure, spraying the rebounding surface in an unpredictable manner. Players run and jump to avoid being sprayed. By changing the length of the loose hose lengths, the randomness of the spray can be tailored. (In other embodiments rather than dousing the players from above, a hose can be positioned beneath the plane of the rebounding surface, and can wet players from below.)

Castle Siege. One or more buckets of water are mounted to posts 44 around the court. The buckets are mounted in a manner permitting them to be capsized, to spill their contents (e.g. the bucket can include two holes on opposite sides of its upper wall, through which the bucket is pivotally suspended, as by a Y-bracket). A player in the trampoline court tries to spill the water on attackers outside the trampoline court (either by directly tipping the bucket, or by pulling on a tipping rope secured to one side of the bucket). The attackers try to knock flags off the support poles (attached by hook/loop fasteners, such as Velcro) by throwing beanbags, balls, or the like. Some beanbags fall inside the court, and are out of play. Others fall outside the court, requiring a close approach by an attacker (within range of a water bucket) if the beanbag is to be recovered and thrown again. The player inside the trampoline wins if all of the beanbags are captured from the attackers. Any attacker who is doused with water is out of play. The attackers win if all flags are knocked down.

TrampScreen. A vertical screen of flexible material is connected to opposing posts 44, or opposite sides of the fence 100, dividing the court into two halves. (The screen can be of various materials including netting, fabric, clear plastic, opaque plastic, etc.) The screen has one or more openings defined therein. Various games can be played involving the passing of one or more balls or other objects from one half of the court to the other.

Speed Ball. Two players have two different colored sets of balls, and a matching colored basket. They race to grab balls of their color (only one may be carried at a time) out of the center basket and put it into their own. Variations can be played with no center basket, or with players stealing or blocking each other's balls.

Jam Ball (one or two players). The enclosure is equipped with two opposed basketball goals. A center line is provided on the trampoline surface at a distance half way between the goals. A lightweight pneumatic ball is used. Each player defends one goal and shoots for the other. A player with the ball may dribble as in basketball. To shoot, a player must bounce the ball off the trampoline surface, jump up and catch the bounced ball in midair, and then shoot the ball at the goal before either the player or the ball lands on the surface. To score a point, the player must start the jump from the side of the centerline that is opposite the target goal. For a higher scoring game, it can be established that a player gets an additional bounce, before shooting, after gaining possession of the ball. Goal tending is not permitted. Rebounding determines control of the ball as in basketball.

Hip Hoop. Each player wears one or more hoops (e.g. extending from a belt) and tries to bounce one or more loose balls up from the rebounding surface and through the hoop.

PostGames. A rigid post can be secured in the center of the chamber, secured at its top to a strap of nylon webbing extended between opposed posts 44. At its bottom the post can be secured to nylon webbing or an elastic cord that extends across the rebounding surface (either on, or spaced above, the surface). The post itself (typically plastic) is desirably covered with foam padding (e.g. extruded foam). Various games can make use of such a structure, e.g. tetherball.

The accessories used in the foregoing can be attached to the fencing or support posts by any known fastener. Desirably, the fasteners are removable (e.g. hooks or Velcro hook/loop fastener), permitting ready removal of the accessories. To reduce risk of injury, it is also desirable that cords stretched across the chamber 106 be elastic, and sufficiently elastic that they can stretch down to the rebounding surface (and below, down to the point of the rebounding surface's maximum deflection) when loaded by a predetermined weight (e.g. the weight of a lightest contemplated user—typically 30–60 pounds).

Many of the foregoing games can likewise be played in a pool, with the associated structures coupled to fence structure around the pool.

It will be recognized that the foregoing games, and the structures associated therewith, are not limited to the particular safety fence of the detailed embodiment, but are equally applicable for use with other trampoline or pool enclosures.

Tent/Awning

It is often desirable to provide a cover or awning over the rebounding surface, e.g. to protect the surface from sun or rain. The above-described embodiments are well adapted to support various such covers.

Figure 11:
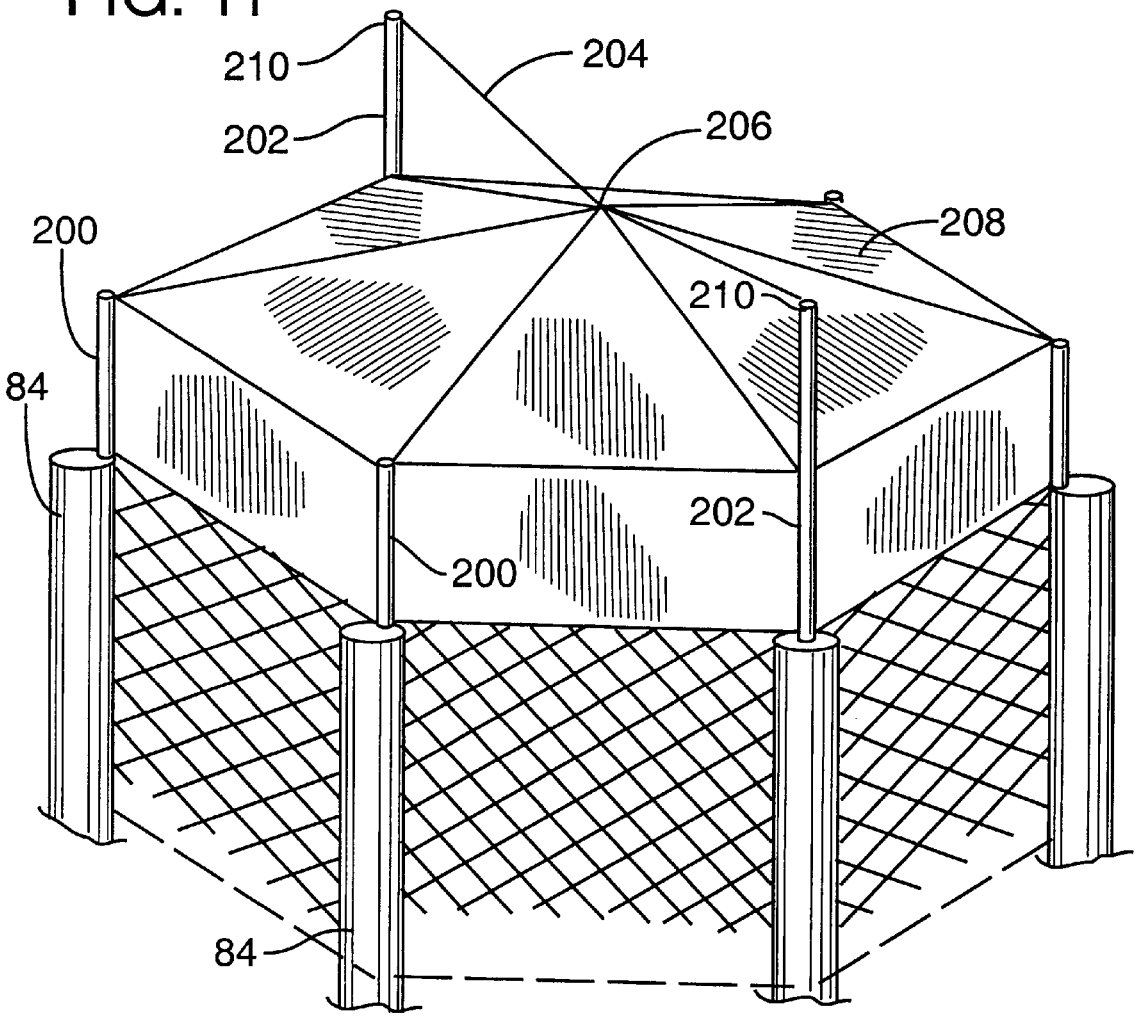
FIG. 11 shows one embodiment of a sun/rain covering that can be used with the embodiment of FIG. 1.

FIG. 11 shows one such embodiment. Short extension poles 200 (e.g. three feet in length) are mounted to the tops of all posts 44 save two. From these two posts extend longer poles 202 (e.g. five feet). These poles can be any of the pole materials noted above, but are typically lighter weight than posts 44. A line 204 (elastic or inelastic) extends between top points 210 of the longer poles, and serves to support an apex 206 of a domed covering 208. The illustrated covering 208 is a waterproofed nylon but other materials (e.g. canvas, plastic, etc.) can of course be used. Inside the covering, attachment points can be provided to suspend game accessories. Only the attachment point at the apex, however, is capable of suspending much weight.

Cable ties, web loops, elastic cord, or other fasteners can couple the covering 208 to the tops of the short extension poles 200, and to intermediate portions of the longer poles 202. Desirably, the cover 208 is not so taut as to significantly interfere with the advantageous independent mobility of the poles 44. The cover 208 is preferably disposed well above the rebounding surface so it does not restrict or interfere with use of the trampoline.

If desired, side walls can extend down from the covering 208—either inside or outside the netting material—to provide additional sun- or rain-protection, or privacy.

The FIG. 11 embodiment can be positioned lower in the chamber 106 by securing line 204 and fabric 208 to lower positions on the posts 44. So doing forms a recreational tent. In such embodiments, mesh windows with zippered rain flap fabric closures are desirably provided in the covering, so the occupants can see out. A doorway is similarly provided, and can be secured by a zipper or Velcro fastener. The line 204 in such embodiment should be elastic, and should be stretchable down to the level of the rebounding surface in order to reduce the possibility of injury.

In a particular hexagonal (or octagonal) "Big Top" tent embodiment, the peripheral margin of the fabric 208 is not attached directly to the posts 44, but is rather coupled to the posts by lengths of elastic cord. Side walls extend down from the peripheral fabric margin and are secured at their bottom edges to the frame 34 (or to the edge of the rebounding surface 40, to the inner periphery of the mat 126, etc.) by short elastic cords. These side walls can be vertical, but in the preferred embodiment slope slightly outwardly as they extend downwardly.

In another embodiment, only the longer poles 202 are used, and line 204 defines a ridgeline over which a rectangular covering fabric is suspended, forming an A-frame-like shelter. The comers of the fabric are secured to the ground by lines extending out beyond the trampoline. By this arrangement, the independent mobility of most of the support posts 44 is not compromised, and the cover can extend over a larger area (e.g. protecting trampoline users from oblique sun and rain).

(Again, the foregoing embodiment can be constructed within the chamber 106 rather than above it. The lines from the corners of the fabric can be elastic and extend to points around the periphery of the fence.)

In yet another embodiment, an arched framework is formed by curved tubes (PVC, aluminum, fiberglass, etc.), each coupling the tops of opposing pairs of posts 44. A fabric covering is then disposed over the framework. (A variant embodiment has an extension tube from each support post 44 terminating at a common apex, and there mating with a multi-input spider fitting. Such an arrangement, however, tends to interfere more with the independent mobility of the support posts 44 than the other embodiments. However, it provides a stronger attachment structure for suspended game accessories.)

Electronic Accessories

In certain embodiments of the invention, a trampoline court can be provided with at least one electronic device physically coupled to a component of the court, and electrically coupled to an associated electronic apparatus. The component can be a sensor that produces an electrical signal corresponding to a sensed physical parameter. Many such sensors are known, and include position sensors, strain sensors, accelerometers, proximity sensors, etc. Many of these (but not all) include piezo-electric elements for converting physical stresses into electrical signals. Others include potentiometers and other variable resistance devices whose resistance changes with a movable element. Such sensors are well known in the physical test and measurement art, so are not belabored here. Such sensors can be mechanically coupled to the rebounding surface, to the elastic members coupling the rebounding surface to the trampoline frame, to any element of the safety fence, etc.

Figure 14:
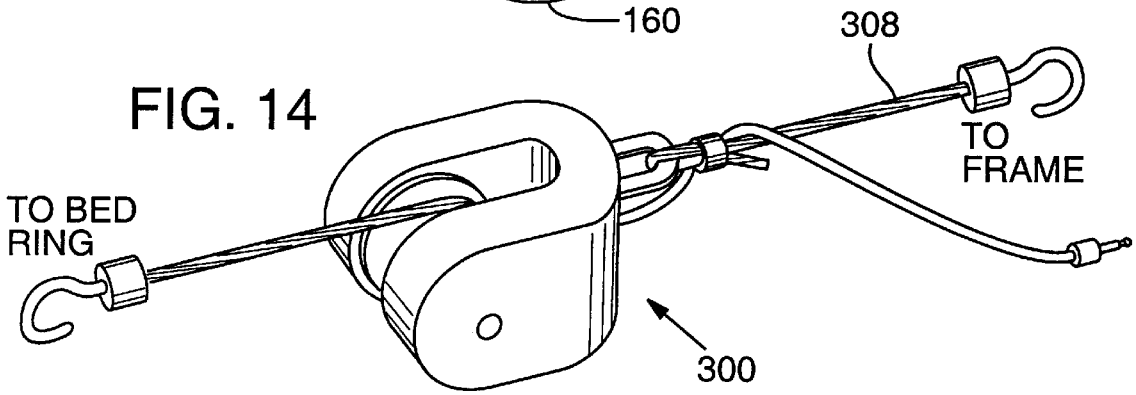
FIGS. 14 and 15 are views of an electronic sensor that can be used with the FIG. 1 embodiment.
Figure 15:
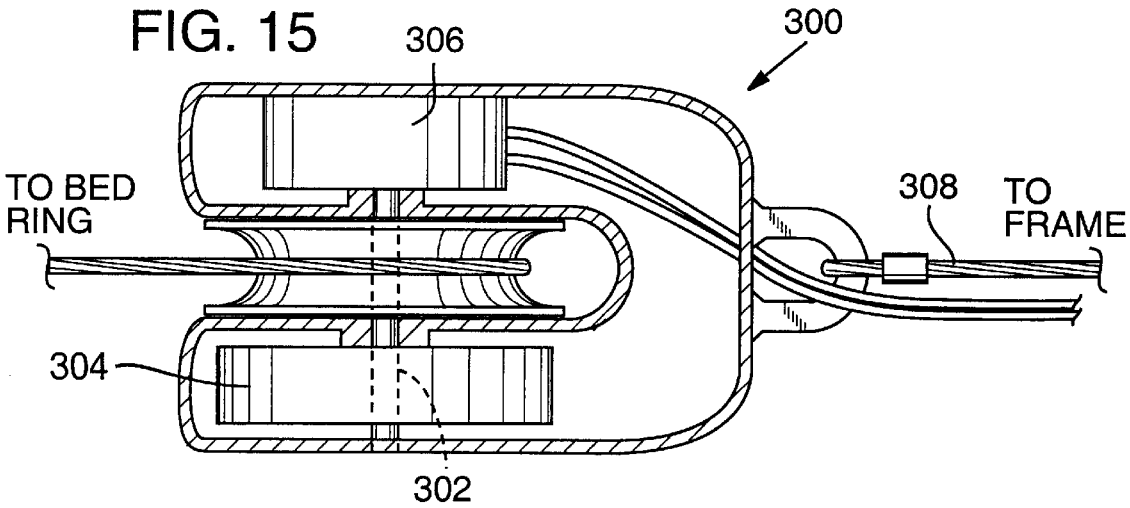

FIGS. 14 and 15 show a sensor that can be hooked between the horizontal frame of the trampoline and the rebounding surface to produce deflection data. The sensor is integrated on a pulley 300, the axle 302 of which is spring biased. When a jumper lands on the rebounding surface, the surface deflects and pulls the axle of the pulley against the force of the spring 304. Movement of this axle causes the tap of a potentiometer 306 to move, changing the resistance across two terminals output from the sensor and coupled to an associated electrical apparatus by a cable 308.

Data from such sensors can be used for various purposes. These include measuring time intervals between actions (e.g. between rebounds), numbers of actions, deflections of the rebounding surface or of an element of the safety fence, positions of impacts on the rebounding surface, force of impact, etc. This data, in turn, can be processed by an associated CPU-based device to calculate further information, such as calories expended, histograms of usage, etc. The CPU-based device, in turn, can include an LCD or other visual display for outputting raw and processed data to the user. A simple embodiment simply tallies bounces on the trampoline. Two counts can be maintained—a lifetime count; and a session count. The latter can be reset with a reset button (much like a car's odometer and trip odometer).

The sensor can be used as input for more than simply display devices. Other embodiments produce sounds in response to each bounce. The sounds can be amplified and played through speakers, either mounted to the poles or near the bottoms of the support legs. If the trampoline system is equipped with one or more speakers, it is desirable to provide an input to which a radio, CD player, or the like can be connected, so that it can play through the system's speakers.

The electrical device need not be a sensor. For example, it can include a momentarily operable switch. It may comprise a keypad. Such a switch or keypad can be used in conjunction with an associated electronic apparatus to keep a game score, or to maintain a log of exercise activity. (Such an electronic apparatus may be simple enough not to require a CPU. For example, it may comprise simple counting circuitry with associated display driver circuitry.)

Above-Ground Pools

As indicated earlier, the same fencing concepts detailed above can be employed with above-ground pools. For example, the upright support poles can be secured to first and second straps positioned around top and bottom edges, respectively, of an above-ground pool. These straps may be robust nylon or polypropylene straps, metal straps, etc. A third strap (e.g. one inch nylon) can link the top of the poles (e.g. six feet above the top edge of the pool). Fence structures like those detailed above can be supported from the vertical poles. Such a fence can serve diverse purposes, including preventing balls and other pool toys from leaving the pool area, and serving as a mounting structure for game related accessories, as described above. The fence can also be used to impede access to the pool by use of a padlock or the like. However, as noted, such arrangements are not foolproof. Accordingly, they should not be relied upon to prevent unauthorized pool use (and possible accidental drowning).

As used herein (including in the concluding claims, unless other elements of a claim preclude such a construction), the term "trampoline" should be read to encompass above-ground pools, and the term "rebounding surface" should similarly be read to correspond to the top water surface of the pool.

Landscaping

A trampoline safety fence can be used as a trellis for growing different plants, particularly vines (e.g. ivy). Trellising plants on the fence serves many purposes, including helping to hide the trampoline and making it better blend into the landscape, shading the court and trampoline (increasing user comfort and protecting the trampoline system components from UV damage), providing a wind break, and providing privacy to trampoline users.

Packaging

Prior art packaging includes certain drawbacks addressed by embodiments of the present invention.

The poles forming the above-detailed support structures are relatively long. If they are single piece, the shipping package is necessarily quite large—perhaps eight feet long. If the poles are multiple-piece, the package girth is increased, to accommodate the plural pieces needed for each support framework. Costs of shipping are related to carton size, making both options relatively disadvantageous.

In the presently-preferred shipping technique, such drawbacks are overcome and additional advantages are provided. The support poles of the preferred embodiment are formed of plural nesting poles. For example, a first (lower) pole is two or three feet long, and has an outer diameter of 1.75 inches. A second (upper) pole is six feet long, and has an outer diameter of 1.5 inches. (Both are 16 gauge.) For shipping, the first pole is coaxially positioned over the second pole, resulting in a net length of just six feet. Moreover, the first pole has a dimple on its end (an artifact of the tube cutting process) that reduces its inside diameter to less than the 1.5 inch outer diameter of the second pole. This prevents the first pole from sliding along the second. Instead, it is constrained to a position at the end of the second pole. This arrested movement overcomes a drawback in some other nested-tube arrangements, in which sliding of shorter tubes is possible, with the possible consequence of inertial damage to the shipping carton (e.g. blowing out an end of the carton).

This nested pole arrangement is desirably slid into a surrounding foam tube, having an opening of about 1.75 inches in diameter. This further constrains any movement of the first pole (due to the close fit within the foam tube). It also protects painted finishes on the poles. The foam tube helps fill air space in the carton, improving the carton's crush-resistance (e.g. when stacked). The foam also protects other contents of the carton (e.g. an instructional videotape) from damage due to encounters with the poles. (The videotape instructs the user in assembly of the safety fence, thereby saving telephone support costs.)

Figure 12:
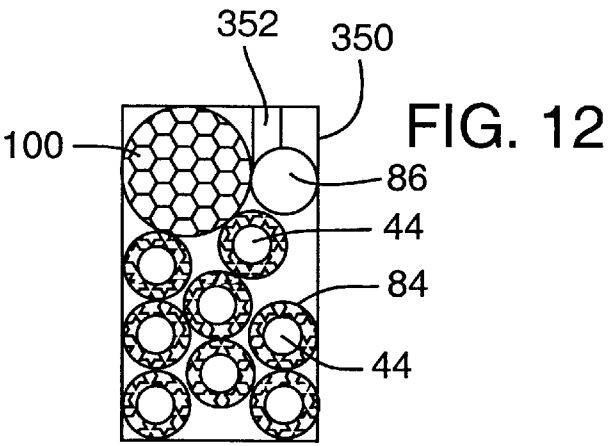
FIGS. 12 and 13 show packing arrangements that can be used in connection with the FIG. 1 embodiment.
Figure 13:
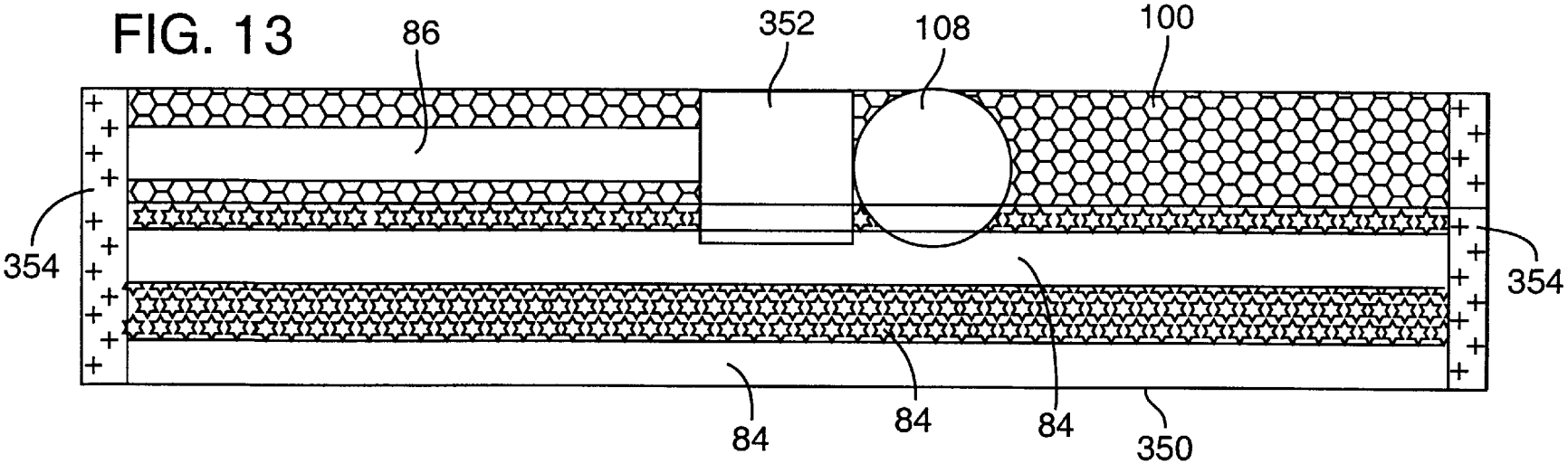

FIGS. 12 and 13 show the packing arrangement of an illustrative shipping carton 350, depicting plural nested poles 44, foam tubes 84, fence netting 100, webbing 108, caps 86, video 352, Styrofoam inserts 354, etc.

The end caps 86 can also be nested. That is, the sleeve portion 91 of one end cap can have an opening large enough to receive the rounded top portion 88 of another end cap. All of the end caps can be serially nested in this fashion.

Packaging arrangements similar to those described above can advantageously be employed for shipment of tubes for other recreational equipment, such as outdoor play structures (swingsets, etc.).

Concluding Remarks

The disclosures of the patents cited herein are incorporated by reference.

From the foregoing disclosure, it will be recognized that the preferred embodiments of the above-detailed enclosure overcomes several drawbacks of the prior art, and provides numerous features not heretofore available.

It will be further recognized that the invention can be practiced in many diverse forms, some quite different from those particularly described above. Many embodiments will not employ the detailed structures, and/or will not overcome the same drawbacks of the prior art, and/or will not provide the same advantages. Some embodiments of the invention may employ structural elements expressly avoided in the preferred embodiment (e.g. fence supports that are rigidly coupled together at their tops), but nonetheless employ other of the novel features disclosed above to provide an advantageous arrangement.

Of course, the principles disclosed above are similarly applicable to trampoline (and pool) shapes other than the round shape illustrated (e.g. rectangular).

Regarding alternative structures, we mean to teach by this disclosure that other structures—reasonably recognized by those of skill in the art to be interchangeable with those disclosed—can alternatively be employed. Thus, there should be no need to particularly detail, e.g., that inclined or arched supports can generally be substituted for vertical supports; that springs can be substituted for elastic cords; that turnbuckles and the like can be substituted for slidable buckles, etc., etc.

In view of the many embodiments in which the principles detailed above can be employed, it should be recognized that the disclosed embodiments are illustrative only and should not be taken as limiting the scope of the invention. Rather, we claim as our invention all such embodiments as may fall within the scope of the following claims, and equivalents thereto.

What is claimed is:

1. A trampoline enclosure system comprising:

a trampoline having a rebounding surface;

a plurality of posts, each post (a) being secured to the trampoline and (b) having a wall support portion located above the level of the surface;

a flexible top line that extends between adjacent posts at an elevation above the rebounding surface;

a bracket secured on one of the posts, the bracket defining at least one opening to receive the top line; and a generally cylindrical wall made of a flexible material that is secured to the wall support portions of the posts and to the top line so that the wall defines a chamber above the rebounding surface.

2. A trampoline enclosure system comprising:

a trampoline having a rebounding surface;

a plurality of posts, each post (a) being secured to the trampoline and (b) having a wall support portion located above the level of the surface;

a flexible top line that extends between adjacent posts at an elevation above the rebounding surface; and a generally cylindrical wall made of fencing that is secured to the wall support portions of the posts and to the top line, with the top line interlaced through openings in the fencing, so that the wall defines a chamber above the rebounding surface.

3. A trampoline enclosure system comprising:

a trampoline having a rebounding surface and a plurality of vertically-extending legs that support the rebounding surface at an elevation above ground level;

a plurality of posts, each post (a) being secured to one of the legs the trampoline and (b) having a wall support portion located above the level of the surface;

a plurality of leg fasteners that secure the posts to the legs, each leg fastener comprising (a) a block having two vertically-extending channels which are shaped respectively to partially receive a leg and to partially receive a post, (b) a first retainer shaped to wedgingly secure the leg in one of the channels, (c) a second retainer shaped to wedgingly secure the post in tie other channel, and (d) at least one spring mounted to serve as a shock absorption element so that the post can move a short distance relative to the leg when a sufficient force is applied to overcome the urging of the spring;

a flexible top line that extends between adjacent posts at an elevation above the rebounding surface; and a generally cylindrical wall made of a flexible material that is secured to the wall support portions of the posts and to the top line so that the wall defines a chamber above the rebounding surface.

4. A trampoline enclosure system comprising:

a trampoline having a rebounding surface and a plurality of vertically-extending legs that support the rebounding surface at an elevation above ground level;

a frame that surrounds the surface and is supported by the legs, the surface being provided by a sheet of fabric that is stretched on the frame;

a plurality of posts, each post (a) being secured to one of the legs the trampoline and (b) having a wall support portion located above the level of the surface;

cable ties that secure the posts to the frame or legs;

resilient members provided between the cable ties and the posts such that a post can move a short distance relative to the leg when a sufficient force is applied on the wall support portion of the post to compress the resilient member;

a flexible top line that extends between adjacent posts at an elevation above the rebounding surface; and a generally cylindrical wall made of a flexible material that is secured to the wall support portions of the posts and to the top line so that the wall defines a chamber above the rebounding surface.

5. A trampoline enclosure system comprising:

a trampoline having a rebounding surface and a plurality of vertically-extending legs that support the rebounding surface at an elevation above ground level;

a frame that surrounds the surface and is supported by the legs, the surface being provided by a sheet of fabric that is stretched on the frame;

a plurality of posts, each post (a) being secured to both the frame and one of the legs and (b) having a wall support portion located above the level of the surface;

a flexible top line that extends between adjacent posts at an elevation above the rebounding surface; and a generally cylindrical wall made of a flexible material that is secured to the wall support portions of the posts and to the top line so that the wall defines a chamber above the rebounding surface.

6. A trampoline enclosure system comprising:

a trampoline having a rebounding surface and a plurality of vertically-extending legs that support the rebounding surface at an elevation above ground level;

a plurality of posts, each post (a) being secured to one of the legs the trampoline and (b) having a wall support portion located above the level of the surface;

a plurality of leg fasteners that secure the posts to the legs, the leg fasteners being pipe clamps, each pipe clamp comprising (a) a hinge having two wings with each wing having a free end portion, the wings together defining a passageway between the wings, which passageway receives both a leg and a post and is located such that the free ends of the wings are located opposite one another when the leg and the post are clamped between the wings and (b) at least one bolt which secures the ends of the wings together and thereby wedgingly holds a leg and a post together in the clamp;

a flexible top line that extends between adjacent posts at an elevation above the rebounding surface; and a generally cylindrical wall made of a flexible material that is secured to the wall support portions of the posts and to the top line so that the wall defines a chamber above the rebounding surface.

7. A trampoline enclosure system comprising:

a trampoline having a rebounding surface;

a plurality of posts, each post (a) being secured to the trampoline and (b) having a wall support portion located above the level of the surface;

a plurality of cross braces, each cross brace having an upper end and a lower end located at an elevation below the upper end, the upper and lower ends of each cross-brace being connected respectively to the wall support portions of two adjacent posts;

a flexible top line that extends between adjacent posts at an elevation above the rebounding surface; and a generally cylindrical wall made of a flexible material that is secured to the wall support portions of the posts and to the top line so that the wall defines a chamber above the rebounding surface.

8. The system of claim 7 wherein:

the cross braces are flexible lines;

the upper ends of the cross braces are attached to the upper ends of the posts; and the lower ends of the cross braces are attached at the bottoms of the wall support portions of the posts.

9. A trampoline enclosure system comprising:

a trampoline having a rebounding surface;

a plurality of posts, each post (a) being secured to the trampoline and (b) having an upper end portion and a wall support portion located above the level of the surface;

a flexible top line that extends between adjacent posts at an elevation above the rebounding surface;

a generally cylindrical wall made of a flexible material that is secured to the wall support portions of the posts and to the top line so that the wall defines a chamber above the rebounding surface; and an end cap at the top of the upper end portion of each post.

10. The system of claim 9 wherein each end cap has a shock absorbing element positioned so that the cap descends for a short distance when downward pressure is applied to the end cap.

11. A trampoline enclosure system comprising:

a trampoline having a rebounding surface;

a plurality of posts, each post (a) being secured to the trampoline and (b) having a wall support portion located above the level of the surface;

a flexible top line that extends between adjacent posts at an elevation above the rebounding surface;

a generally cylindrical wall made of a flexible material that is secured to the wall support portions of the posts and to the top line so that the wall defines a chamber above the rebounding surface; and an awning which extends over the chamber and which is supported by at least some of the posts.

12. A trampoline enclosure system comprising:

a trampoline having a rebounding surface;

a plurality of posts, each post (a) be secured to the trampoline and (b) having a wall support portion located above the level of the surface;

a flexible top line that extends between adjacent posts at an elevation above the rebounding surface;

a generally cylindrical wall made of a flexible material that is secured to the wall support portions of the posts and to the top line so that the wall defines a chamber above the rebounding surface; and a basketball backboard supported by at least one of the posts.

13. A trampoline enclosure system comprising:

a trampoline having a rebounding surface;

a plurality of posts, each post (a) being secured to the trampoline and (b) having a wall support portion located above the level of the surface;

a flexible top line that extends between adjacent posts at an elevation above the rebounding surface;

a generally cylindrical wall made of a flexible material that is secured to the wall support portions of the posts and to the top line so that the wall defines a chamber above the rebounding surface;

a generally vertically-extending interior post; and an interior post support structure which holds the interior post at a position inside the chamber.

14. A trampoline system comprising:

a trampoline, including a substantially horizontal frame having a rebounding surface coupled thereto, and plural legs positioning the frame above the ground; and a fence support structure including plural support members;

wherein at least one of said support members is coupled by a first removable fastener to a leg, and by a second removable fastener to the frame.

15. The system of claim 14 wherein each of said first and second removable fasteners includes at least one U-bolt.

16. A trampoline system comprising:

a frame;

a rebounding mat coupled to the frame;

plural legs that extend upwardly from the ground, are coupled to the frame, and support the frame above the ground;

plural vertically extending independent poles, each pole being coupled to only one of the legs, each pole having an upper end portion at an elevation above the frame, and each pole being spaced apart from the other poles without interconnecting members that inhibit bowing of the poles; and an encompassing expanse of flexible material that is coupled to the independent poles and that defines a chamber above the rebounding mat, the frame, the legs, the poles and the flexible material being interconnected such that at least some of the poles can bow and act as tubular springs that can become loaded with energy in the manner of a drawn bow when a person in the chamber impacts the flexible material and that can distribute impact forces from the flexible material to the legs, whereafter energy stored in the poles is promptly released as a reaction force that urges the impacted portion of the flexible material back towards the center of the chamber, which pushes the person back towards the center of the chamber.

17. A trampoline system according to claim 16 further comprising a flexible loop that links the upper end portions of the poles.

18. A trampoline system according to claim 17 wherein the loop comprises a line that is made of a flexible material, that extends pole-to-pole and that connects the upper end portions of the poles such that the line permits constrained movement of upper end portions of two adjacent poles relative to one another.

19. A trampoline system according to claim 17 wherein the line is made of a substantially inelastic material.

20. The system of claim 9 wherein the flexible material has a bottom margin that is positioned below the plane of the rebounding surface.

21. The system of claim 9 wherein the flexible material has overlapping end portions that provide a flap door.

22. The system of claim 16 wherein the flexible material has a bottom margin that is positioned below the plane of the rebounding mat.

23. The system of claim 16 wherein the flexible material has overlapping end portions that provide a flap door.

24. The system of claim 9 wherein two overlapping portions of the flexible material define a passageway that permits access to the chamber.

25. The system of claim 9 further comprising resilient sheaths around the posts.

26. The system of claim 25 wherein the flexible material is connected such that when a person in the chamber impacts the flexible material, the impact is partially absorbed by one or more of the resilient sheaths.

27. The system of claim 25 wherein:

at least one of the posts is mounted so that it does not extend to the ground;

the top line is substantially inelastic, extends post-to-post, and connects the upper end portions of the post such that the line permits constrained movement of upper end portions of two adjacent post relative to one another; and the flexible material is connected such that when a person in the chamber impacts the flexible material, the impact is partially absorbed by one or more of the resilient sheaths.

28. The system of claim 25 wherein:

at least one of the posts is mounted so that it does not extend to the ground;

the flexible material is connected to at least one elastic member; and the flexible material is connected such that when a person in the chamber impacts the flexible material, the impact is partially absorbed by one or more of the resilient sheaths.

29. The system of claim 25 wherein:

at least one of the posts is mounted so that it does not extend to the ground;

the flexible material is connected to at least one of the post by at least one elastic member;

the top line permits movement of upper end portions of two adjacent posts relative to one another; and two overlapping portions of the flexible material define a passageway that permits access to the chamber.

30. The system of claim 9 wherein:

the trampoline comprises a frame; and at least one of the posts is secured to a horizontally extending portion of the frame.

31. The system of claim 9 wherein at least one of the posts is mounted so that it does not extend to the ground.

32. The system of claim 16 wherein two overlapping portions of the flexible material define a passageway that permits access to the chamber.

33. The system of claim 16 further comprising resilient sheaths around the poles.

34. The system of claim 33 wherein the flexible material is connected such that when a person in the chamber impacts the flexible material, the impact is partially absorbed by one or more of the resilient sheaths.

35. The system of claim 33 wherein at least one of the poles is mounted so that it does not extend to the ground.

36. The system of claim 35 wherein:

the system further comprises a top line that is substantially inelastic, extend post-to-post, and connects the upper end portions of the posts such that the line permits constrained movement of the upper end portions of two adjacent posts relative to one another; and the flexible material is connected such that when a person in the chamber impacts the flexible material, the impact is partially absorbed by one or more of the resilient sheaths.

37. The system of claim 35 wherein:

the flexible material is connected to at least one of the poles by at least one elastic member; and the flexible material is connected such that when a person in the chamber impacts the flexible material, the impact is partially absorbed by one or more of the resilient sheaths.

38. The system of claim 35 wherein:

the system further comprises a top line that is connected to the poles and permits movement of upper end portions of two adjacent poles relative to one another;

the flexible material is connected to at least one of the poles by at least one elastic member; and two overlapping portions of the flexible material define a passageway that permits access to the chamber.

39. The system of claim 16 wherein at least one of the poles is secured to a horizontally extending portion of the frame.

40. The system of claim 16 wherein at least one of the posts is mounted so that it does not extend to the ground.

* * * * *

UNITED STATES PATENT AND TRADEMARK OFFICE

CERTIFICATE OF CORRECTION

PATENT NO. : 6,261,207 B1
APPLICATION NO. : 09/432998
DATED : July 17, 2001
INVENTOR(S) : Publicover et al.

It is certified that error appears in the above-identified patent and that said Letters Patent is hereby corrected as shown below:

On the Title Page

Item [75] Inventors: should read as follows: Mark W. Publicover, Saratoga, California;
Jon H. Greiner, Palo Alto, California;
J. Scott Publicover, Boise, Idaho;
Donald W. Strasser, Saratoga, California Signed and Sealed this Eighth Day of December, 2009

David J. Kappos

David J. Kappos
*Director of the United States Patent and Trademark Office*